US007334502B1

(12) United States Patent
Durkee

(10) Patent No.: US 7,334,502 B1
(45) Date of Patent: Feb. 26, 2008

(54) MULTI-PURPOSE HAND TOOL METHOD & APPARATUS

(76) Inventor: Kenneth Durkee, 201 Mt. Park Blvd. SW. #C202, Issaquah, WA (US) 98027

( * ) Notice: Subject to any disclaimer, the term of this patent is extended or adjusted under 35 U.S.C. 154(b) by 0 days.

(21) Appl. No.: 11/724,475

(22) Filed: Mar. 14, 2007

Related U.S. Application Data

(60) Provisional application No. 60/783,445, filed on Mar. 17, 2006.

(51) Int. Cl.
*B25F 1/04* (2006.01)
*B25B 7/22* (2006.01)
*B25D 1/00* (2006.01)

(52) U.S. Cl. ..... 81/20; 7/127

(58) Field of Classification Search ..... 81/20; 7/127, 128, 138
See application file for complete search history.

(56) References Cited

U.S. PATENT DOCUMENTS

| | | | | |
|---|---|---|---|---|
| 95,796 | A | 10/1869 | Granier | |
| 415,923 | A | 11/1889 | Painter | |
| 874,394 | A | 12/1907 | Cork et al. | |
| 1,321,777 | A | 11/1919 | Stepanian | |
| 1,331,793 | A | 2/1920 | Wojdacz | |
| 1,469,589 | A | 10/1923 | Palmer | |
| 2,769,359 | A | 11/1956 | Healy | |
| 3,798,687 | A | 3/1974 | Stevens | |
| 3,858,258 | A | 1/1975 | Stevens | |
| 4,798,111 | A | 1/1989 | Cheeseman | |
| 4,960,016 | A | 10/1990 | Seals | |
| 4,995,128 | A | 2/1991 | Montgomery | |
| 5,033,140 | A | 7/1991 | Chen | |
| D335,806 | S * | 5/1993 | Visic | D8/55 |
| 5,280,659 | A | 1/1994 | Park | |
| 5,432,968 | A | 7/1995 | Beck | |
| 5,535,650 | A | 7/1996 | McNatt | |
| 5,636,398 | A | 6/1997 | Fike | |
| D384,264 | S | 9/1997 | Liou | |
| 5,920,935 | A | 7/1999 | Beck | |
| 6,199,454 | B1 | 3/2001 | Bergbower | |
| 6,257,106 | B1 | 7/2001 | Anderson et al. | |
| 6,349,623 | B1 | 2/2002 | Peters | |
| D465,711 | S | 11/2002 | Moore et al. | |
| 6,701,560 | B2 | 3/2004 | Foley | |
| 6,725,486 | B2 | 4/2004 | Oka | |
| D503,322 | S * | 3/2005 | Albertson | D8/55 |
| D520,829 | S * | 5/2006 | Albertson | D8/55 |
| 7,162,758 | B2 * | 1/2007 | Skinner | 7/127 |
| 2003/0154552 | A1 | 8/2003 | Oka | |

* cited by examiner

*Primary Examiner*—David B Thomas
(74) *Attorney, Agent, or Firm*—Robert B. Hughes; Hughes Law Firm, PLLC

(57) ABSTRACT

A combination tool comprising first and second sections designated a "hammer section" and a "wrench section" which as their names suggest, have a hammer function and a wrench function, respectively. These two sections are releasably and pivotally connected to one another at a pivot location so that these cooperate to function as pliers. The tool also accomplishes other functions. The handles of each of these sections each have a storage section for other components such as screw drivers, socket wrenches, a cutter, a can opener, a bottle opener, and other functions.

20 Claims, 13 Drawing Sheets

14
20
16
30
28
34
32
18
12

139
142
142
144

MULTI-PURPOSE HAND TOOL METHOD & APPARATUS

RELATED APPLICATIONS

This application claims priority benefit of U.S. Ser. No. 60/783,445, filed Mar. 17, 2006, which is incorporated by reference.

BACKGROUND OF THE INVENTION a) Field of the Invention

The present invention relates to a combination tool, and more particularly to a combination tool which occupies a relatively small volume so that it could be easily carried by a person or stowed in a small area.

b) Background Art

There are a wide variety of multi-purpose tools which combine various combinations of functions which can include two or more functions, such as the functions of pliers, a wrench, socket driver, a hammer, cutting, etc. Desirably, such tools should be structured so as to be compact, convenient to use, and have (as much as possible) a wide variety of functions.

More particularly, it would be desirable to have such a tool which could be used in emergency situations where a bulky tool kit is not available. This could be, for example, where a person would need to make emergency repairs on a vehicle, such as an automobile or a motorcycle.

c) Summary of Invention

There is a multipurpose tool providing hammer, pliers, and wrench functions. It comprises first and second main sections, which in turn comprise, respectively, a hammer handle section and a wrench handle section pivotally connected to one another. Several jaws are mounted to the two main sections to accomplish the main functions. In addition, there are auxiliary function components removably stored in the two handle sections, these providing drive functions and miscellaneous additional functions.

BRIEF DESCRIPTION OF THE DRAWINGS

FIG. 31A is a somewhat schematic view of an outer contour of a nut, a head of a bolt or the like;

DESCRIPTION OF THE PREFERRED EMBODIMENTS a) Preliminary Description of the First Embodiment In beginning this description of the first embodiment of the present invention, reference is initially be made to FIGS. 1-6. This first embodiment comprises an apparatus 10 which can be termed "a combination tool 10", and it comprises a first main section 12 and a second main section 14. For ease of description, in the following text the first main section 12 will be designated the "hammer section 12", and the second main section will be designated the "wrench section 14". This is done to simplify the description, since in the following drawings the first section can more easily be identified by observing that it has a quite visible hammer head as one of the components of that section, and the second section is more easily identified by the presence of the wrench that is part of that second section.

As will become apparent in the following detailed description both of these main sections (i.e., the hammer section 12 and the wrench section 14) have many more functions than are suggested simply by those titles. Also, this is not done to indicate that the hammer function and the wrench function necessarily be relegated to these exact functional locations, since some combinations of components within the scope of the present invention may not require this exact arrangement relative to providing those components.

Figure 3:
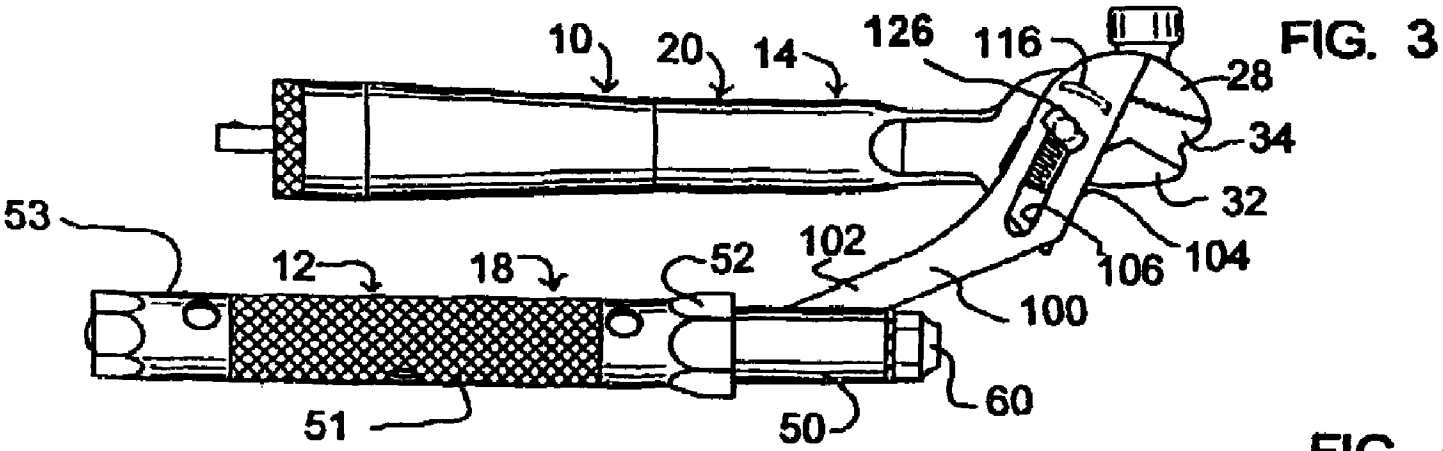
FIG. 3 is a view similar to FIG. 1, but looking at the rear face of the tool.
Figure 4:
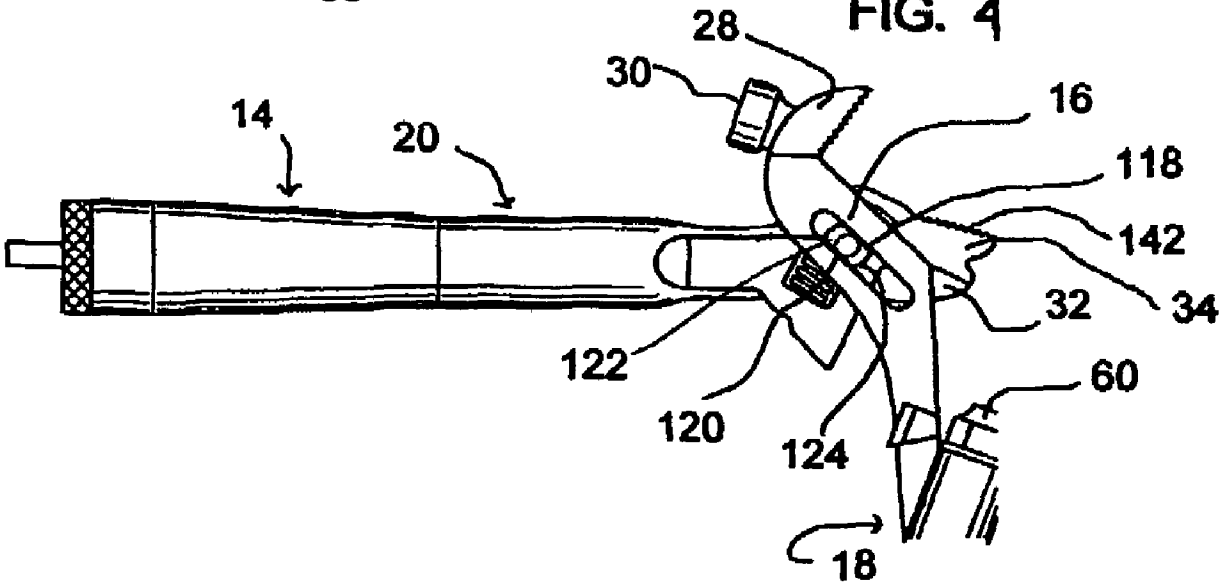
FIG. 4 is a view similar to FIG. 3, except that the tool is in a "spread position"

The hammer section 12 and the wrench section 14 are joined together by means of a pivot connection 16 (see FIGS. 3 and 4). The hammer section 12 comprises a hammer handle section 18 and the wrench section 14 has a wrench handle section 20. Also, with this pivot connection 16, the two sections 12 and 14 function in the manner of a pliers (and also with a cutting section and wire stripping section) and the portions of these two sections 12 and 14 that accomplish the pliers functions shall be included in the designation of a "pliers operating section 22". Also the two handle sections 18 and 20 shall collectively be called "the handle section 24" (see FIG. 1).

Several components of the first and second sections 12 and 14 cooperate to provide three functions that are immediately obvious when a person first looks at the apparatus and these will be called the "three basic functions" of the apparatus 10, these functions being a hammer function, a wrench function, and the pliers function. To accomplish these three basic functions there are certain components that make up a combination which is called the "basic operating section 26" which in turn comprises three jaws. First there is a hammer head jaw 28 (which has a hammer head 30, and as its name suggests is part of the hammer section 12), and this jaw 28 also operates in this embodiment to accomplish the pliers function. Second there is a wrench jaw 32 which is mounted in the wrench section 14 and serves a wrench function. Finally, there is a middle jaw portion 34 which operates to accomplish both the pliers function and the wrench section. The arrangement of these components will be described in more detail later herein. Also the term "three basic functions" is not to be interpreted to obscure the fact there are other important functions of this apparatus 10, and these other functions will be described later herein.

b) Definitions of Positions, Reference Locations and Certain Basic Functions

In order to permit the description of the apparatus 10 to proceed in a more orderly manner, there will now be a brief discussion of terminology which will be used in this text. It will be noted from observing FIGS. 1 and 2 that in FIG. 1, the hammer section 12 and wrench section 14 are spaced further from one another. This position will be referred to as the "distant position" of these two sections 12 and 14. Then in FIG. 2 these two section 12 and 14 are positioned more closely adjacent to one another, and accordingly, this will be called the "adjacent position". As will be discussed later herein, there are also intermediate locations.

Figure 1:
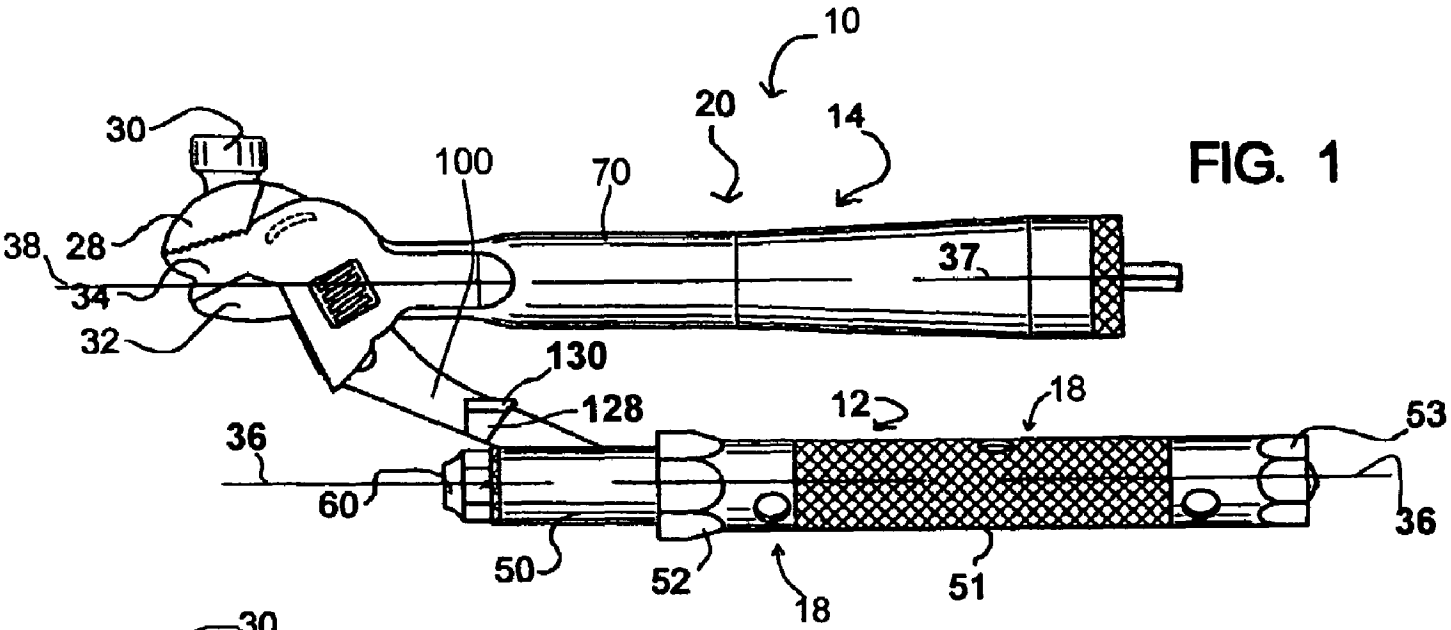
FIG. 1 is a front elevational view looking at the front face of a first embodiment of a combination tool of the present invention, with two main sections of the tool being further from one another in a "distant position"
Figure 2:
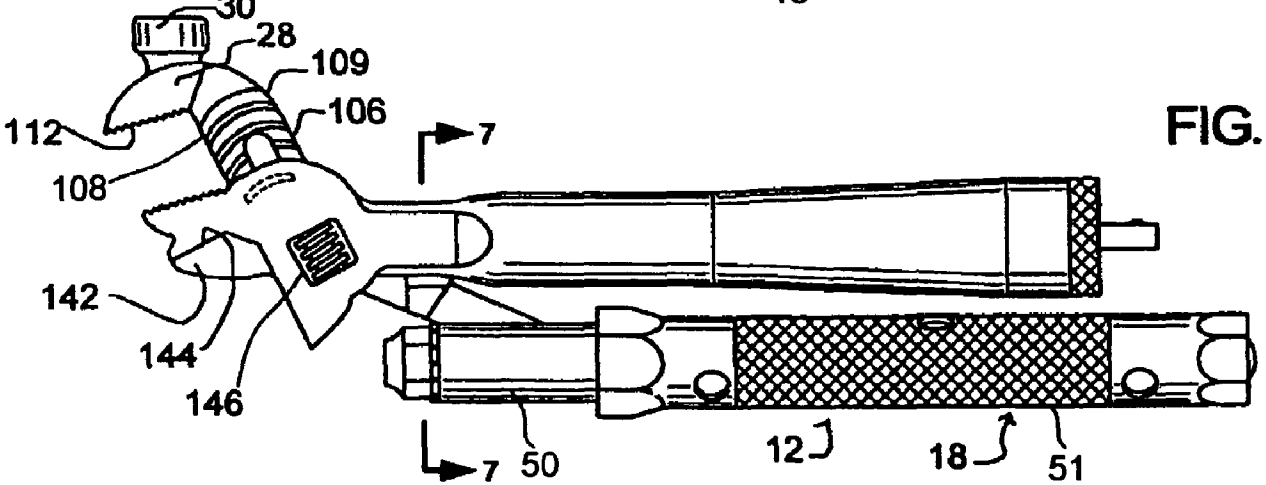
FIG. 2 is a view similar to FIG. 1, but showing the two sections positioned closer to one another in an "adjacent position"

With reference to FIGS. 3 and 4, FIG. 3 shows the apparatus 10 in generally the same way as in FIG. 1, except that FIGS. 1 and 2 are looking at what is called the "front side" and FIGS. 3 and 4 are views looking at the opposite side called the "rear side". FIGS. 3 and 4 illustrate the manner in which the apparatus 10 can function as a pliers, and in FIG. 3 the hammer section 12 and wrench section 14 are shown in what will be called a "gripping position" since the two jaws performing gripping function. In this position the hammer head jaw 28 and the middle jaw 34 are closer to one another, and in like manner the two handle sections 18 and 20 are closer to one another. In FIG. 4 the two sections 12 and 14 will be considered as being in the "spread position", this being one of the positions in using the apparatus 10 as a pliers. Obviously, both the distant position and the adjacent position, as well as the closed position and spread position, can have various intermediate positions.

Also, the position of the main sections 12 and 14 in FIG. 4 (i.e., the spread position) is also the same position which can be called a "connect/disconnect position" since (as will be described in more detail later herein) this is the position where the pivot connection 16 between these two sections 12 and 14 can be made and also the position in which the two sections 12 and 14 can be disconnected from one another.

Figure 5:
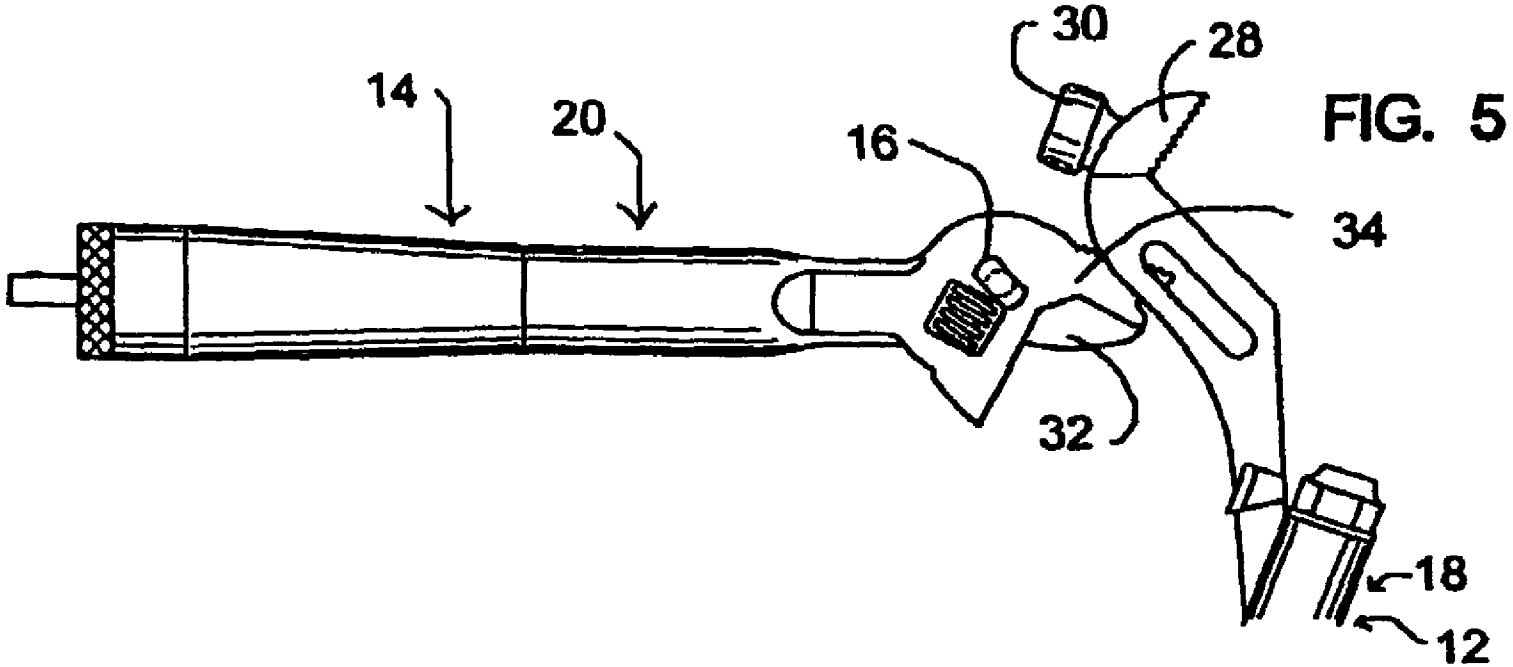
FIG. 5 is a view similar to FIG. 4, showing the two main sections being separated from one another.
Figure 6:
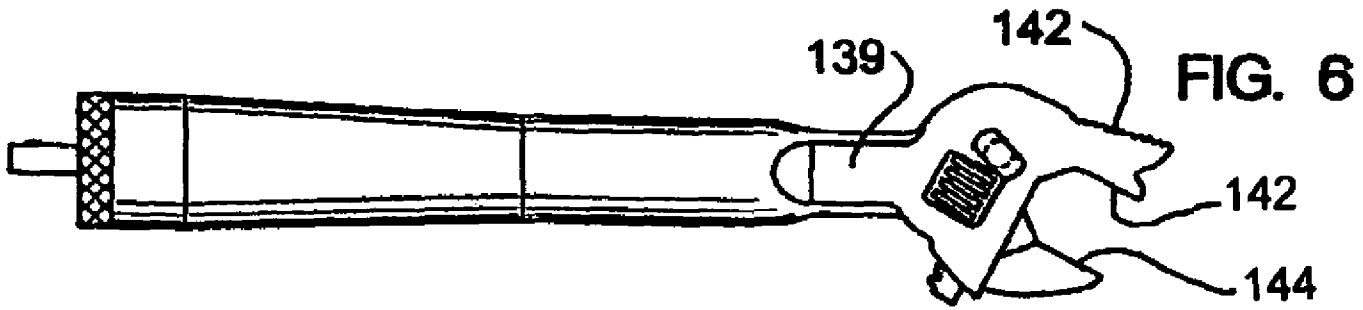
FIG. 6 is a rear elevational view of the second main section (what is called the "wrench section") separated from the hammer section.

FIG. 5 shows the hammer section 12 and the wrench section 14 having just been disconnected from the position of the FIG. 4. FIG. 6 shows the wrench section 14 by itself in its disconnected position, and (as will be described later herein) this is a position where it can be used simply as a wrench, without being encumbered by the attachment to the hammer section 12.

Further, to facilitate the further description of the apparatus 10, the hammer handle section 18 shall be considered as having a hammer handle longitudinal axis 36 (see FIG. 1), and likewise the wrench handle section 20 shall be considered as having a wrench handle longitudinal axis 37 (see FIG. 1). Also there is a middle reference axis 38 generally parallel to and between the two axes 36 and 37. Desirably the two axes 36 and 37 are generally parallel to one another in the closed position of FIG. 1. However, these axes 36 and 37 could spread somewhat or slant downwardly toward one another. Also, the apparatus in its closed position of FIG. 1 shall be considered as having an upper end at which the basic operating section 26 (having the three jaws 28, 32 and 34) is located, and the term "lower" shall denote the location which is (relative to the longitudinal axes 36 and 37) at the end portion of the apparatus 10 opposite to the upper end. Thus, the term "upwardly" will be used to denote a direction which is from the lower end to the upper end, and shall also be used to denote relative locations. The term "down" or "downwardly" would denote the direction from upper end to the lower end or relative locations.

Also, the term "inner" shall denote proximity to either of the longitudinal axes 36 and 37, while the term "outer" shall designate a location or direction that is extending radially outwardly from either axis 36 or 37 or a relative location from either of the axes 36 or 37. The term "front" shall refer to that portion of the apparatus that can be seen in FIGS. 1 and 2, and the term "rear" shall denote the opposite side that is shown in FIGS. 3 and 4. Therefore, the term "rearward" shall denote a direction from the front side to the rear side, and the term "forward" shall denote the opposite.

The term "right" shall denote a location of the wrench handle section 14 in FIGS. 1 and 2 relative to the hammer handle section and the term "left" will denote the opposite. Thus, in the orientation of FIGS. 1 and 2 the wrench handle section 20 is on the right side relative to the hammer handle section 18.

Figure 7:
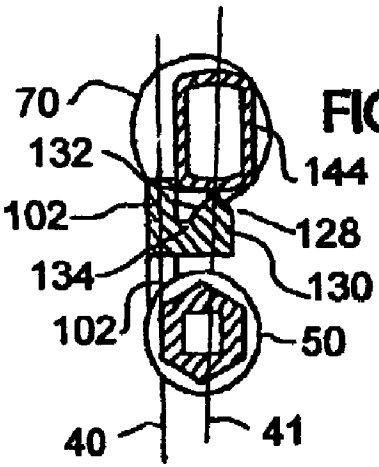
FIG. 7 is a sectional view taken along line 7-7 of FIG. 2.
Figure 9:
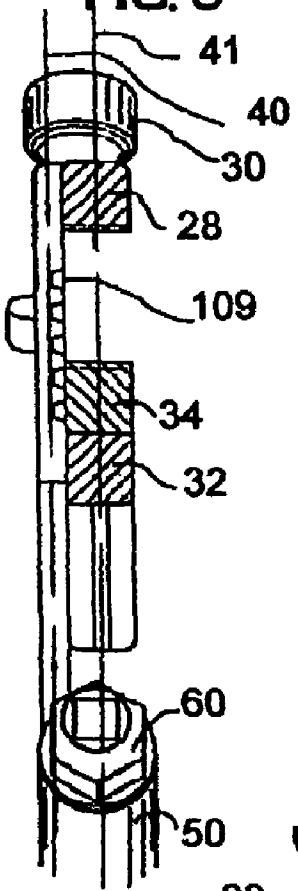
FIG. 9 is a sectional view taken along lines 9A-9A of FIG. 2.

Also there are front and rear reference planes 39 and 40, respectively, which are parallel to each other and vertically and horizontally aligned in a right to left direction, the location of these being shown in FIGS. 7 and 9, and with the forward reference plane 39 extending through the center of three jaws 28, 32 and 34.

Obviously, since the tool 10 and components thereof are used in a great variety of orientations, all of these directional and location terms (i.e., "upper", "lower", "front", "rear", "right" and "left") are arbitrary designations and do not at all reflect the orientation of the apparatus 10 in any particularly position or location, and are merely used for convenience in referencing the locations as these components as shown in the drawings.

c) Overview of the Handle Section 24 (i.e., the Hammer Handle Section 18 and the Wrench Handle Section 20)

As will become apparent when reading further in this text, the two handle sections (i.e., the hammer handle section 18 and the wrench handle section 20) perform many functions beyond simply functioning as a handle for accomplishing the three basic functions described above (i.e., the hammer function, the wrench function and the pliers function). One of the important functions that is performed by components of both of the handle sections 18 and 20 is to provide storage of various components. Further, components of the section 18 and 20 function to operate(or cooperate) in some of the various drive functions that are accomplished by the apparatus 10, as well as other functions.

Therefore, in the following description, those components that contribute to the various drive functions shall be considered part of what will be termed "the drive section 41". Also those components that contribute to the storage function shall be considered part of what will be termed "the storage section 42". Further, it is to be understood that some of the components that are included in these two sections 41 and 42 may overlap so as to have a functional relationship in both the storage function and the drive function, as well as possibly other functions that are accomplished.

d) The Hammer Handle Section 18

To describe this section 18, reference will first be made to FIGS. 10 through 16. Also, FIGS. 23 to 27 show use of some of the components of the hammer handle section 20 used in conjunction with components from the wrench handle section 20. In this section "d" there will be a brief overview of the various components and their functions. Then later in this text is a more detailed description, which will present in more detail both their physical configurations and also their functions.

Figure 10:
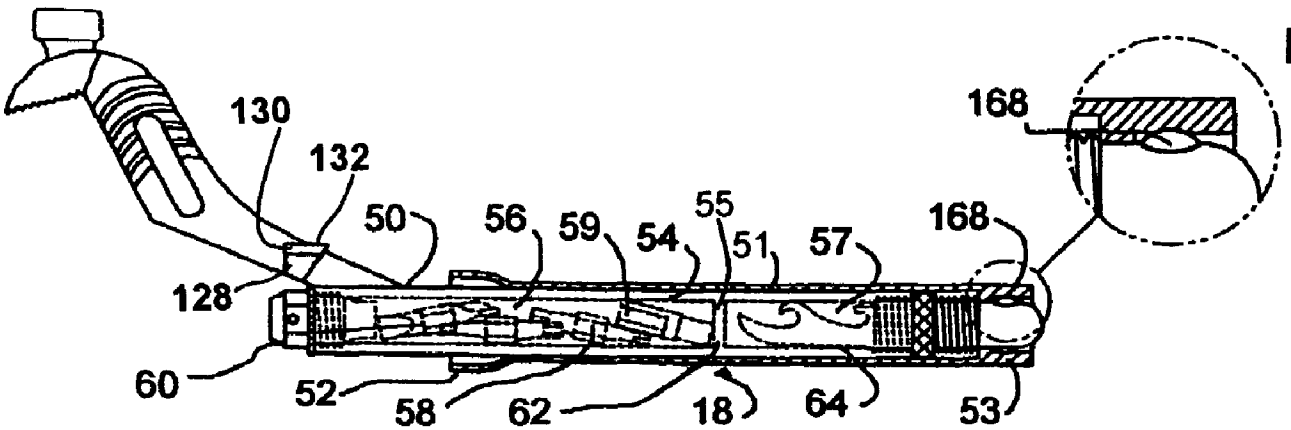
FIG. 10 is a view looking toward the front surface of the hammer section, with the handle and outer socket wrench portion being shown in section and with other components being shown in broken lines.

With reference to FIG. 10, there is a cylindrical tubular hammer handle structure 50 which is surrounded by an outer generally cylindrical shell 51. The handle structure 50 functions as a handgrip section and is a basic structural member of the hammer handle section 18, and the surrounding shell 51 has upper and lower drive sockets 52 and 53, respectively, of a larger and smaller size, removable socket wrench, as well as participating in some of the drive functions.

The handle structure 50 comprises a storage region 54 which is divided by a wall 55 into an upper storage region 56 and a lower storage region 57. The upper storage region 56 holds a number of screw tips 58 having different configurations, and also a drive adaptor 59 which will be described in detail later herein. The upper end of the upper storage region 56 is closed by an end plug/connecting drive member 60. As its name suggests, this member 60, beyond serving the plug function, also operates as a drive or drive connecting component.

In the lower storage region 57, there is located in its stowed position an auxiliary multi-purpose tool 64. As will be disclosed later in this text, this tool 64 is able to function as a can opener, a bottle opener, a knife, a hack saw blade, and a file. In its non-use position, this multi-purpose tool 64 (see FIGS. 11 and 14) is stowed in a protected manner within the lower storage region of the handle structure 50 and then it can be mounted in several ways (or used independently) to accomplish its various functions.

The configuration and also operating positions of these components can be seen at least partially in FIGS. 11 through 16, and (as indicated previously) these will be discussed later in this text.

e) The Wrench Handle Section 20

In describing this wrench handle section 20, reference will initially be made to FIGS. 17 through 22 and later in this text, various uses of the components will be discussed relative to FIGS. 27 through 30. To turn our attention back to FIG. 17 through 22, there is a handle structure 70 which has a basically cylindrical tubular configuration, but with the handle structure 70 having a moderate taper so as to expand in its diameter from an upper end to a lower end.

The handle structure 70 extends upwardly to connect to its upper structural head portion 71 which in turn connects to an upwardly positioned operating end of the wrench section 14. Thus, the handle 70 with its upper head potion 71 functions structurally and operatively as the handle of the wrench section 14. Further, most of the interior of the handle structure 70 functions as a storage region 72 in which there is located in the stowed position a plurality of socket members 74.

Figure 17:
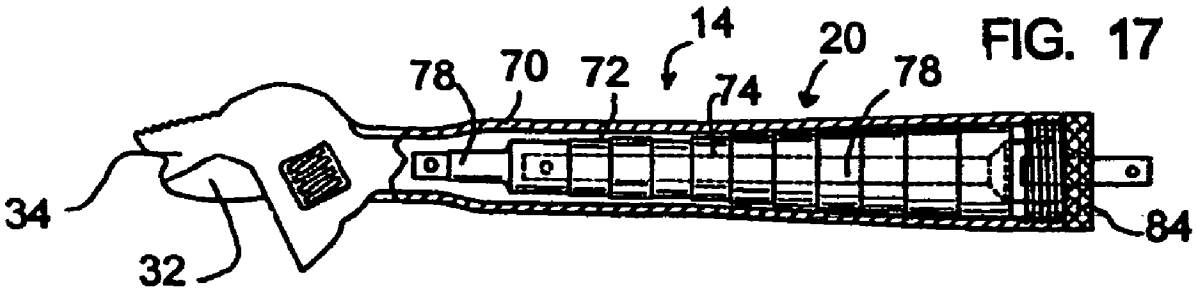
FIG. 17 is a view taken in section along a wrench handle longitudinal axis of the wrench section, showing the components that are stored within its storage region, with these being socket members and a lever drive member.

Each socket member 74 has (as will be explained in more detail later herein) upper and lower socket portions 75 and 76 for each socket member 74, and also a central drive connecting opening 77 having a square shaped through opening. Further, these socket members 74 are stacked one top of the other end to end, with the larger diameter socket portion (see FIG. 21) 76 being at the lower end, and the smaller diameter portion 75 being at the opposite upper end (as seen in the stacked position of FIG. 17), and with these diameters diminishing in a lower to upper direction (as seen in FIG. 17).

At the upper end of the stack of socket drivers 74, there is a separate end drive connector 78 which is used in various drive operations of this apparatus 10. It can be used as an extension drive member and has an upper square drive portion and at the other end a square socket drive portion. The wrench handle section 20 further comprises a lever drive member 79 which comprises an elongate handle portion 80 having a square cross section and a driver end portion 81 which is hinge mounted at 82 to the handle portion 80 at the lower end thereof. This handle portion 80 and the driver end portion 81 each have a square configuration in cross section. In FIG. 17, the lever drive member 79 is shown in its stowed position in the storage region 72 in the handle structure 70. Although these drive connections are described as square recesses and square male connecting members, it is evident that these could have other configurations such as being hexagonal, etc.

At the lower end of the wrench handle section 20 there is a plug 84 which is threaded into the lower end of the handle structure 70. In the stowed position of FIG. 17, the driver end portion 82 of the lever driver member 79 extends through an opening in the plug 84. This lever drive member 79 is in and of itself a tool already known in the prior art and is commonly referred to as a "breaker bar".

The five socket members 74 have nearly identical configurations, except for the diameter dimensions. This configuration will be described briefly with reference to FIGS. 25 and 26. As described above, each socket member 74 has a upper and a lower socket portions 75 and 76, with the upper socket portion 75 not only having a diameter less than the lower socket portion 76, but also with the surrounding side wall having a smaller outside surface diameter for the upper portion 75 and a greater side wall diameter at the lower portion. There is for each socket member 74 the central drive connector 77 (see FIGS. 18 and 19) having a square opening configuration, and having a width dimension which is sized so as to match in connecting drive relationship with a drive connector, such as the driver end 81. Thus, the central openings of the central drive connector 77 have identical drive openings 77 of the same size.

In the stowed configuration, the aforementioned lever drive member 80 extends through the socket members 74 in their stacked condition as shown in FIG. 17.

Figure 18:
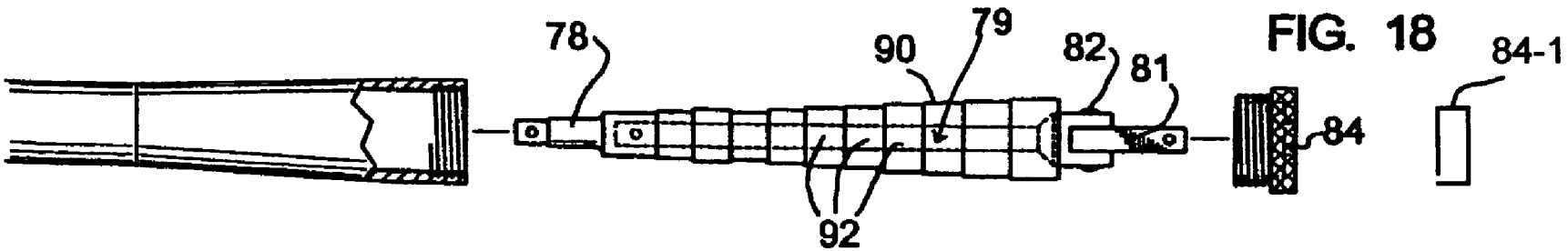
FIG. 18 is a view similar to FIG. 17, but showing the stowed components of FIG. 17 removed from the handle.

In an alternative configuration, the plug could be replaced by a retractable tape measure (e.g., a thirty inch tape measure which is indicated somewhat schematically at 84-1 in FIG. 18) and which would be removably connected to the end of the handle 20. This would require some reconfiguration of the end components at the end of the handle.

f) More Detailed Description of the Components and Operation of the Basic Operating Section 26 Relative to the Hammer, Wrench and Pliers Functions (i.e., Components 12 through 38)

Figure 8:
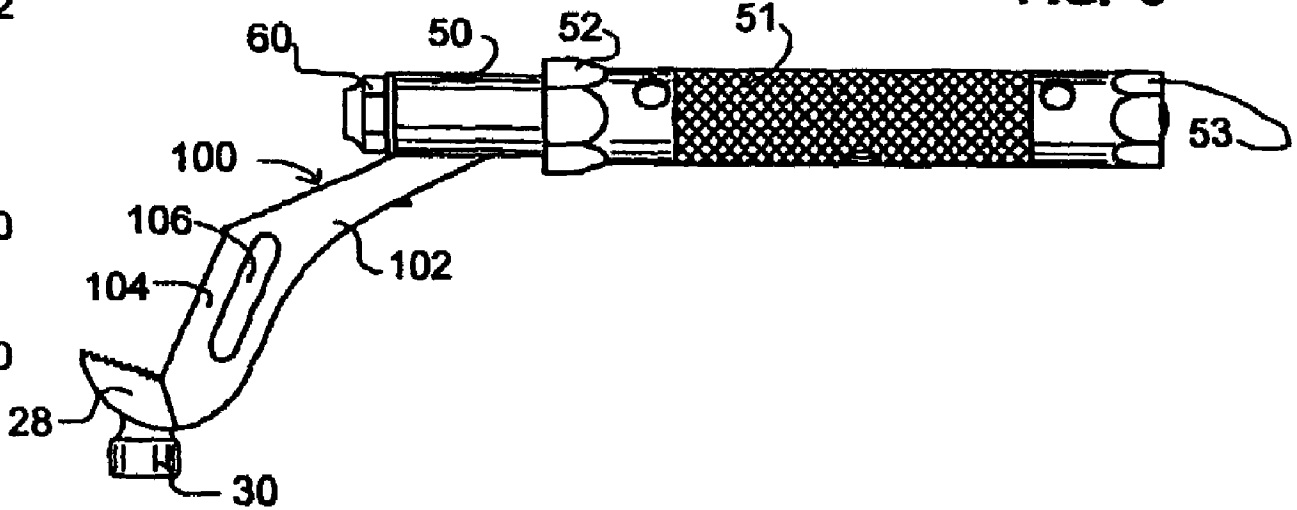
FIG. 8 is an elevational view of the first main section which is called the "hammer section", looking at the rear face thereof.

In this section of the text, we turn our attention first back to FIGS. 1 through 6 to describe in more detail the components shown in FIGS. 1 through 6 and described in section "a", and also to FIGS. 7, 7A and 8. This section will be divided into appropriate subsections.

i) The Hammer Section 12

The hammer section 12 can best be explained by making reference initially to FIGS. 3, 4, 5 and 16.

There is a hammer extension arm 100 which is a rigid structural member which connects the handle structure 50 with the hammer head 30 and the jaw 28. This arm 100 is either fixedly connected to, and/or made integrally with, the handle structure 50 of the hammer handle section 18, as well as the hammer head 30 and the jaw 28. This extension arm 100 has flat parallel front and rear surfaces. The hammer extension arm 100 can be described as a cross-over arm and has a lower connecting portion 102 that connects to the upper end portion of the handle structure 50, and continues to extend upwardly and at a moderate lateral slant to cross the middle reference axis 38 (as seen in FIG. 1), and to structurally transition to the engage/disengage and positioning hammer arm portion 104. For convenience this arm portion 104 will simply be called the "upper central hammer arm portion 104". This arm portion 104 is formed along its length with a connect/release slot 106. It is at this slot 106 that the pivot connection and release of the hammer section 12 and the wrench section 14 is accomplished.

Figure 16:
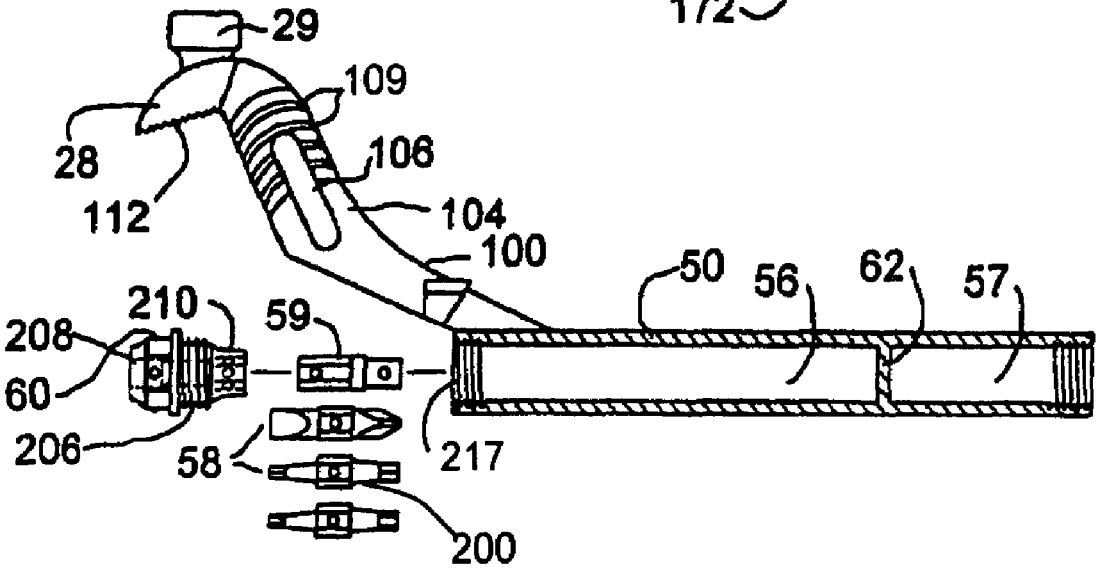
FIG. 16 is a view partly in section of the hammer section and also showing separately several screw tips and a drive adaptor which are stowed in the handle section, and also a plug/connecting device of the hammer section.

Also, as can be seen in FIGS. 2 and 16 this central arm portion has a positioning arm portion 108 in the form of a plurality of evenly spaced curved grooves 109 (see FIG. 2) which are located on a forwardly facing flat surface of the central hammer arm portion 104, and these are operative to accomplish the positioning function for the pliers operation.

Finally, there is the end hammer head connecting portion 110 of the support arm 100 that extends further laterally with a moderate upward slant to connect to the aforementioned hammer head jaw 28 and to the hammer head 30 or these could be positioned apart from one another. The jaw 28 is (or may be) made integrally with the hammer head jaw 30. The hammer head jaw 28 has a contact surface 112 which faces toward a matching contact surface 114 on the aforementioned middle jaw 34, with these two jaws 28 and 34 thus providing the two contact surfaces for the pliers function.

To discuss further the operating functions of the hammer section 12, let us turn our attention to the curved positioning grooves 109, relative to their positioning function. These grooves 109 are arranged to engage a matching curved positioning ridge 116 that can be seen in broken lines in FIG. 3. This ridge 116 is formed on an adjacent rear surface of the wrench section 14 that is at or close to the hammer head jaw 28 (see FIG. 1). This enables the position of the hammer handle portion 18 to be shifted relative to the wrench handle section 20 between the two positions shown in FIGS. 1 and 2, and in intermediate locations to thus increase or decrease the distance between the hammer head jaw 28 and the middle jaw 34. This type of connection is of itself conventional in the art, and these are commonly known as water pump pliers or slip jaw pliers.

Let us now turn our attention to the pivot connection 16 which was discussed quite early in this text, and this can best be done by observing FIGS. 3 and 4. As mentioned previously in this section (f) i)), it was indicated that there is a connect/release slot 106 which functions as part of a pivot connection and also the release and connecting operation of the hammer section 12 with wrench section 14. The other component of the pivot section 16 is a pivot connecting member 1 18 that is connected to the wrench section 14.

This pivot connecting member 118 comprises a retaining portion 120 which has a moderately elongate configuration. It has two side surfaces 122 which are spaced from one another by a distance slightly less than the width dimension of the slot 106. Then it has two end surfaces 124 which are spaced from one another at a distance which is greater than the width of the slot 106, but which is less than the length dimension of the slot 106. The retaining portion 120 is connected to the wrench section 14 by a cylindrical connecting member 126 (shown by the round broken line of FIG. 3) which has a diameter slightly less than the width of the slot 16 and can slide in the slot 106.

Thus, it can be seen with reference to FIGS. 3 and 4, that in the closed position in FIG. 3 the retaining portion 120 holds the hammer section 12 and the wrench section 14 together in pivoting relationship. Then when the two sections 12 and 14 are moved to the spread position in FIG. 4, the length of the slot 106 is aligned with the lengthwise axis of the retaining portion 120 and it is possible to disengage the two sections 12 and 15 from one another as illustrated in FIG. 5.

To discuss yet one more feature of the hammer section 12, there is fixedly connected to a side surface of the lower arm connecting portion 102 of the hammer support arm 100 a cutting member 128 which has cutting portion 130 having a cutting edge 132 which faces to the right (as shown in FIG. 1), so that when the hammer section 12 and the wrench section 14 are in their adjacent position of FIG. 2, the cutting edge 132 is adjacent to a surface of the handle portion of the wrench section 14. The cutting section 130 with the cutting edge 132 is located in the forward reference plane 38 (see FIG. 7) and is connected by a connecting portion 134 to the lower connecting arm portion 102 which is located in the rear reference plane 39. The cutting edge 132 at its fully closed position is in slight contact with an adjacent surface of the upper portion of the handle structure 70 of the wrench section. This cutting member 130 can thus function as a wire cutter or the like. Also, it can be contoured t function also as a wire stripper.

When the hammer section 12 is to be used primarily in its function as a hammer, then it is common that the outer shell 51 would be removed so that the person accomplishing the hammering would be able to grasp the handle structure 50 of the handle hammer section 18 directly with his (her) hand. Also the hammer section could be disconnected from the wrench section 14.

ii) The Wrench Section 14

As indicated earlier, the wrench section 14 can be used separately as a wrench, and this could be done whether or not the wrench is in the connected position as shown in FIGS. 1 through 3, or in a totally disconnected position as shown in FIG. 6 so that it would not be encumbered by the hammer section 12.

As discussed earlier in this text, the wrench handle section 20 comprises a handle structure 70 which is a structural member. In addition to this, the handle structure 70 also has an upper structural portion 139 (see FIG. 6) that is fixedly connected to (or made integrally with) the upper end of this handle structure 70, and is fixedly connected to (or made integral with) the upper structural portion of the wrench operating structure. As indicated earlier herein, the middle jaw 34 is a fixed jaw in that it remains stationary relative to the handle structure 70. Thus, the upper wrench structural portion 139 makes the rigid connection between the middle jaw 34 and the handle structure 70 or could be made integrally with these.

Also, the middle jaw 34 has a second contact surface 142, and the adjustable wrench jaw 32 has a matching contact surface 144 that faces the stationary wrench contact surface 142. Also, as indicated previously, there is mounted to a side surface of the upper wrench structural portion 134 the aforementioned pivot connecting member 118. Also, as indicated earlier, the wrench handle section 20 has the storage region 72 which is closed at its lower end by means of a threaded plug 84.

When the wrench section 12 is used solely as a wrench, it would not be necessary to remove the several socket members 74 and the lever drive member 78. However, all of those stored items could be removed from the storage region 72 and the handle structure 70 would still be fully capable of functioning as a handle for the wrench section 14.

In other respects, the entire wrench section 14 is substantially the same as, or can be similar to, a conventional wrench with an adjustable jaw member. The moveable wrench jaw 32 is mounted to the upper operating end of the handle section 14 and it would have a positioning helical positioning screw 146 which can be rotated in the usual manner to move the wrench jaw 32 to various operating positions.

g) More Detailed Description of Components of the Hammer Handle Section 18

Earlier in this text, there were brief descriptions of the following components of the hammer handle section 18, these components being:

i) the surrounding shell 51 (i.e., the socket wrench portion);

ii) the multi-purpose tool 64;

iii) the screw tips 58;

iv) the end plug/connecting drive member 60.

Each of these will now be discussed in more detail.

i) The Surrounding Shell 52 (the Socket Wrench 52)

Figure 11:
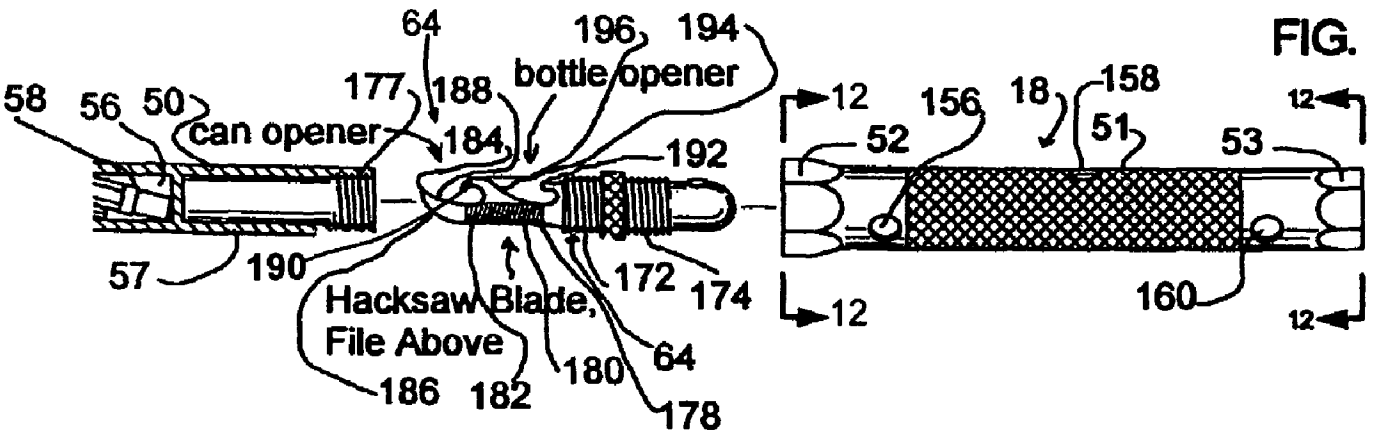
FIG. 11 illustrates portions of the handle structure of the hammer section along with the socket wrench and an auxiliary multi-purpose tool.
Figure 12:
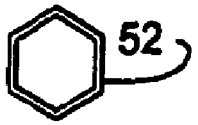
FIG. 12 is an end view taken at line 12-12 of FIG. 10.
Figure 13:
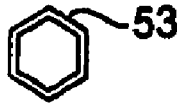
FIG. 13 is a view taken at line 13-13 of FIG. 10.
Figure 14:
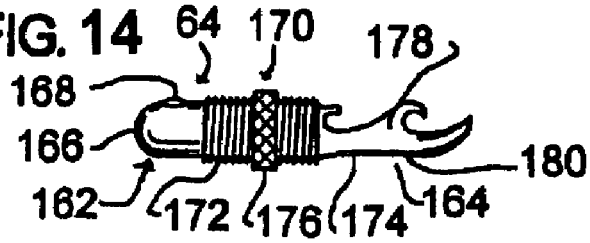
FIG. 14 is a side view of the above-mentioned auxiliary multi-purpose tool illustrated in FIG. 10.

With reference first to FIGS. 10 through 13, the shell member which functions as a socket wrench 51 comprises a generally cylindrical body 51 having at one end an upper larger socket 52 (the end portion of which is shown in FIG. 12), and a smaller lower end socket 53 (the end portion being shown in FIG. 14). Also, the body 51 of the socket wrench 52 has three pair of diametrically opposed drive openings (six in all) with only half of these being shown in FIG. 11, these comprising an upper pair of openings 156, an intermediate set of openings at 158 and a lower set of openings at 160. Any one of these sets of openings can be utilized by a drive member to rotate the socket wrench 51, and in FIG. 30 the aforementioned lever drive member 79 is shown in its drive connection position in the upper set of openings 156.

ii) The Auxiliary Multi-Purpose Tool 64

This auxiliary multi-purpose tool 64 is shown in a number of these drawings, and reference will be made first to FIG. 14 which shows this tool 64 separate from other components, and later to FIG. 11. This tool 64 can be considered as having a handle/mounting section 162 (hereinafter called the handle section 162) and an operating section 164. For ease of description, this tool 64 will be considered as having a first end portion where the operating section 164 is located and a second end portion where the handle section 162 is located.

At the second end of the handle section 162 there is a cylindrical end handle portion 166 (see FIG. 14) with a hemi-spherically curved rear end surface, and there is a spring loaded connecting element 168 on the cylindrical side wall of the rear end handle portion 166. It is to be understood that this apparatus has, or may have, various releasable spring loaded protruding connectors, such as at 168 to make various connections. The handle section 162 also comprises a connecting portion 170 comprising a second threaded portion 172 and a first threaded portion 174.

Then there is a wrench contact portion 176 which is located between the two threaded connecting portions 172 and 174. This wrench contact portion 176 has a perimeter surface in the form of a regular hexagon so that are six surfaces arranged in three pairs of surfaces that are diametrically opposed so that these can be engaged by a wrench. Alternative, it could be a circular knurled surface.

As can be seen in FIG. 11, the lower end portion of the handle structure 50 of the hammer handle section 18 has a cylindrical threaded recess 177, with the threads of this recess 177 matching the threaded outer surfaces of the two connecting portions 172 and 174.

Figure 15:
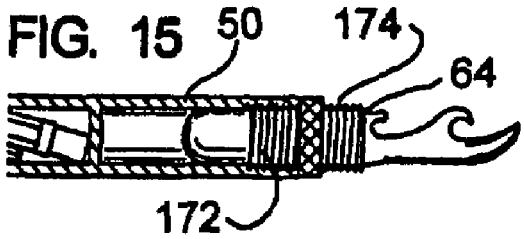
FIG. 15 is a cross sectional elevational view, showing a rear portion of the handle structure of the hammer section and showing the hand/insert tool of FIG. 13 connected to this handle structure in its second operating position.

In the stowed position of FIG. 10, the operating section 164 is positioned within the lower storage region 57, and the forward threaded connecting portion 172 is threaded into the recess 177 (see FIG. 10). Then in the operating position of the tool 64, the tool is positioned as shown in FIG. 15 where the rear set of threads 172 are positioned in the threaded recess 177.

For ease of illustrating in describing the operating section 164 of the multi-purpose tool 64 reference will now be made to FIG. 10. In this manner we can avoid the drawing of FIG. 14 becoming unduly cluttered with various numerals and lead lines.

To turn our attention now to the operating section 164, the overall configuration of the operating section 164 is that it is made as a flat metal material having oppositely positioned substantially flat parallel side surfaces. The operating section 164 will be considered as having a base portion 176 which is fixedly connected to (or possibly made integrally with) the forward connecting portion 174. At the lower edge of base section 176 there is a saw edge 180 which can function as a hack saw, or possibly some other type of saw or cutting or abrading device.

The planar side surface 182 of the base section that is immediately adjacent to the saw edge 180 is made as a file surface 182, and there is a front edge tip 184. Then at the very front end of the operating section 164, there is an all-purpose convexly curved cutting edge 186. This cutting edge 186 is downwardly facing (as seen in FIG. 11) and is shown as an extension of the saw edge 180. At the opposite edge from the cutting edge 186 there is a can opener cutting edge 188. Then immediately behind that cutting edge 188 there is a can opener hook 190, so that the cutting edge 188 and the hook 190 function as a can opener.

Then there is a rear bottle opener hook 192, and this cooperates with an upper edge contact bottle opening surface 194 so that the operating section 164 also functions as a bottle opener.

Reference is now made to FIG. 10 which shows the multi-purpose tool 64 in a stowed position along with the screw tips 58. In that position in FIG. 10, the tool 64 is held by its threaded connection 172 in the handle structure 50, and the socket wrench 51 is held in this position around the handle structure 50 by means of the spring loaded connecting element 168 which (as can be seen in FIG. 10), releasably holds the socket wrench 51 in its place.

FIG. 11 shows these elements that are present in FIG. 10 disconnected from one another. The first step is to remove the socket wrench 52 by simply pulling the socket wrench 52 off the handle structure, and in the process depressing the connecting element 168. Then the multi-purpose tool 64 can be unthreaded from its engagement with the threaded recess 177. The rear end portion of the tool 164 could then be inserted into the lower open end of the handle structure 50 so that the threads 174 engage the threads 177 so that the tool 64 is the in the operating position of FIG. 15.

As an alternative, this tool 64 could be inserted into the lower socket 154 of the socket wrench 52. The tool 64 remains somewhat loose, but is retained in that position by the spring loaded connecting element 168.

iii) The screw tips 58

The screw tips 58 are illustrated in their contained position by broken lines in FIG. 10. Two of these screw tips 58 are illustrated in FIG. 16. Each screw tip 58 has a central connecting portion 200 which in this particular version has six flat sides to form a rectangular hexagon, and this is able to fit directly into a matching recess in its associated end plug/connecting drive member 60.

Figure 23:
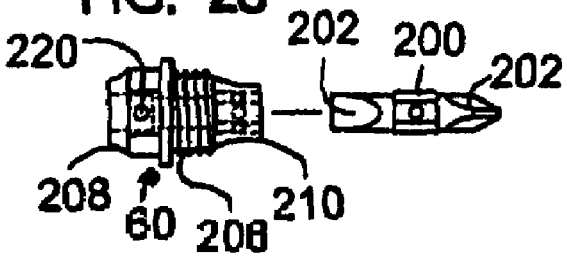
FIG. 23 is a side view of the plug connecting drive member with a screw tip in a position to be inserted in the plug/connecting drive member.
Figure 24:
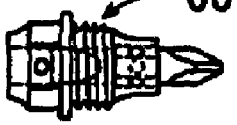
FIG. 24 is a view similar to FIG. 23, but showing the components of FIG. 23 connected to one another to form a stub screw driver.

As illustrated in FIGS. 23 and 24, when the screw tip 58 is inserted into the recess of the plug/connecting device 60, one end tip of the screw tip member 202 is in its operating position, and the other tip is positioned within the connecting drive member 60. In this position, these components function as a stub screw driver.

iv) The end plug/connecting device member 60

For convenience, this will be called the "connecting drive member 60", and it can best be seen in FIGS. 23 through 26. This member 60 can be considered as having three sections namely a center threaded plug portion 206, an upper socket portion 208 with a square recess and four flat square perimeter surface portions, and a lower hexagonal socket portion 210, with the socket portions 208 and 210 being positioned on opposite sides of the threaded plug portion 206.

As indicated previously, this member 60 functions as a plug, and this is accomplished by threading the member 60 into the threaded upper end portion 212 of the handle structure 50. In that position, the plug member 60 encloses the upper storage region 56.

The square socket portion 208 has (as it's name implies) a square socket which can receive a square shaped drive member. In like manner, the hexagonal socket portion 210 has a hexagonal socket and this serves as a drive connection for each of the screw tips 58 or other hexagonal drive members or other components. When the member 60 is simply used as a plug, it would normally not have any of the screw tips 58 or any drive member connected to it, but this could be done. Also, while it is probably self evident, it should be pointed that the designations "square socket portion 208" and "hexagonal socket portion 210" are not intended to limit those particular components to having any particular type of socket, and this term is used in this text since it is easier to remember in reading this rather extended text by having a more descriptive (non-limiting) designation.

Figure 25:
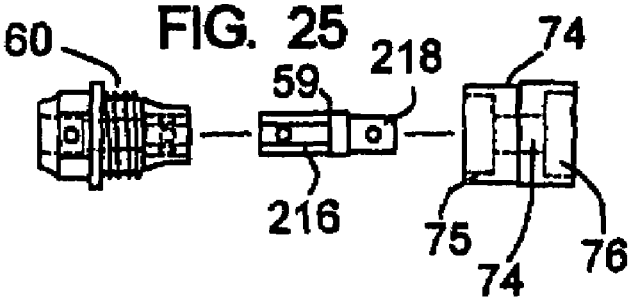
FIG. 25 is a view similar to FIG. 23, but showing the plug/connecting drive member along with a drive adaptor and a socket member, these being in alignment with one another but spaced from one another.

Also, with reference to FIG. 16 and also to FIG. 25, there is the earlier mentioned adaptor drive member 59 which is stowed in the upper storage region 56, and which has on one end a hexagonal drive end 216 and a square drive end 218. As can be seen if FIG. 23 and 24, and as previously mentioned, each screw tip 58 can be inserted directly into the hexagonal socket portion 210 to form the screw driver combination in FIG. 24.

Figure 26:
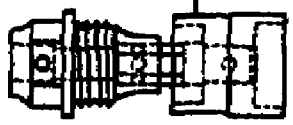
FIG. 26 is a view similar to FIG. 25 but showing the components of FIG. 25 connected together in a socket wrench configuration.

In another arrangement of FIGS. 25 and 26, the adaptor drive member 59 has its hexagonal drive portion 216 insert into the hexagonal socket portion 210, and its other square end portion 218 inserted into a socket recess of one of the socket members 74 which is one of the components of the wrench handle section 14. This makes the combination shown in FIG. 26, and this can be used as a stub socket wrench.

Figure 27:
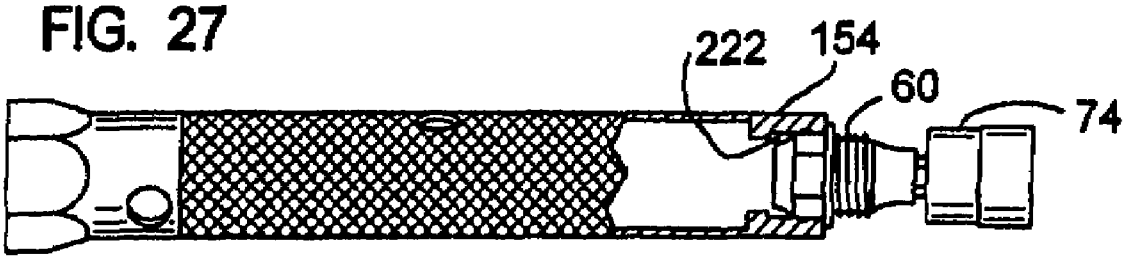
FIG. 27 is a view somewhat similar to FIG. 26, but showing the components of FIG. 26 mounted into a small socket end of the socket wrench.

FIG. 27 shows another configuration where the plug connecting drive member 60 is used in conjunction with the lower small socket 154 of the socket wrench 52. With reference to FIG. 23, the square socket portion 208 of the plug drive member 60 has (as indicated previously) an exterior perimeter configuration of a hexagon, so as to have six symmetrically arranged flat surfaces. Also, there is shown at 220 a spring loaded connecting member which is on one of the flat surfaces of the hexagonal square socket portion 208, and which protrudes outwardly a short distance in the manner of a previously described connector 168. Also, it can be seen in FIG. 27 that the lower small socket member 154 has a plurality of small interiorly facing connecting recesses 222.

When the hexagonally contoured square socket portion 208 is inserted into the hexagonal socket member 154, the spring loaded protruding connecting member 220 will connect in one of the six inner flat surfaces of the smaller socket member 154. Then one of the socket members 74, having the square central connecting opening can connect to the drive portion 218 of the adaptor driver member 214.

h) Further Discussion of The Components of The Wrench Section 14

It is believed that most of the components of the wrench section 14 have already been discussed adequately in the previous text. To summarize these briefly, there is the wrench handle structure 70 which connects through an upper wrench structural portion 139 with the wrench jaw 32, so that the handle structure 70, the upper structural portion 179 and the wrench jaw 32 are one rigid or integral structure. This upper structure portion 139 is located in the forward reference plane 38, and it provides the surface against which the cutting member 126 operates.

Then there are the socket members 74 which are stacked with one another, in the stowed condition in the storage region 72 of the handle of the handle structure 70. The lever drive member handle portion 79 extends in the stowed condition through the square central openings 77 of all of the socket members 74 and connects to the upper drive connector 78, which can function as an extension drive member.

Figure 19:
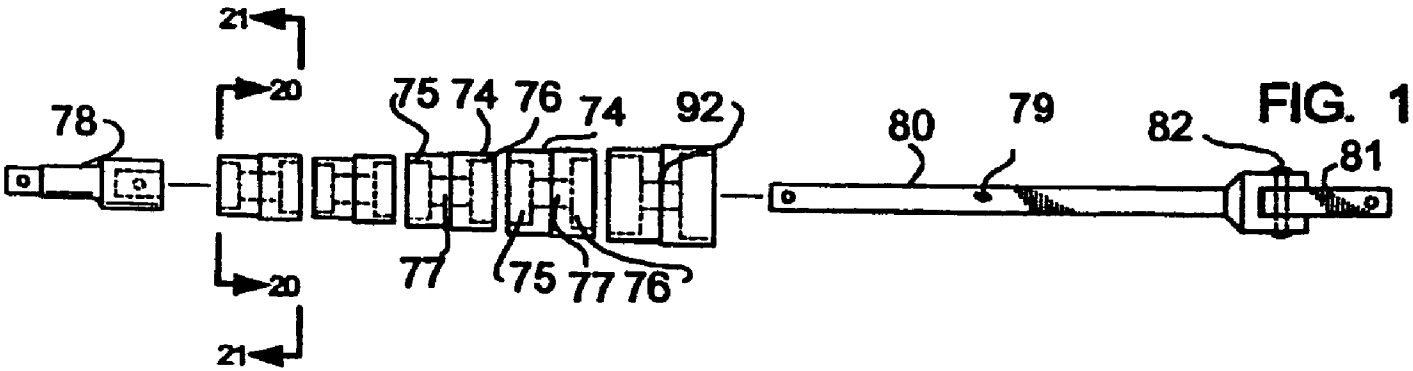
FIG. 19 is a view similar to FIG. 18 but further showing the various socket members and the lever drive handle spaced from one another.
Figure 20:
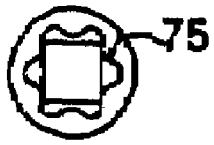
FIGS. 20 and 21 are views which are taken at lines 20 and 21, respectively, of FIG. 19.
Figure 21:
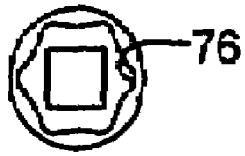

In FIG. 17 all of the components of the wrench section 14 are shown under stowed condition, as described above. To remove any of these components from the storage region 72, as shown in FIG. 18, the end cap 84 is unscrewed, and the socket members 74, the extension drive member 78 and the lever drive member 79 are all removed from the storage region 72. Then each of those components (as shown in FIG. 19) can be separated from one another.

Figure 22:
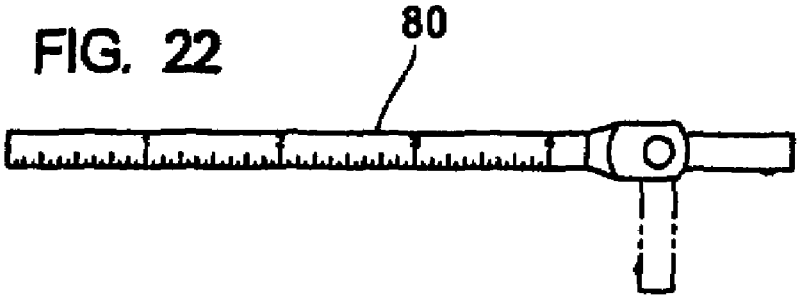
FIG. 22 is a side view of the lever drive member with an inch and metric scale imprinted on a side surface thereof.

To describe some additional features, it will be noted that in FIG. 22, one of the flat surfaces of the handle portion 80 of the lever drive member 79 has imprinted thereon a measuring scale 226 which is in inches. Also, it is to be understood that on another of the flat surfaces of the handle portion 80 (this could be the opposite surface), there could be a metric measuring scale.

Earlier in this text, it was stated that the apparatus 10 comprised a drive section 41 which was made up of various drive components, and some of which are stowed in the hammer section 12 and some of which are stowed in the wrench section 14. The components from both of these sections 12 and 14 can be combined in various ways to perform a multiplicity of drive functions and other functions. Some of these were discussed with reference to FIG. 23, where four of the drive components are shown in various combinations, and also shown to be in drive and engagement with one or more of the socket members 74 of the wrench section 14. Thus, in FIG. 23 and 24, the plug/connection section 60 is shown being used as a stub screw driver where it engages one of the screw tips 58. In FIGS. 25 and 26, there is shown this same plug/drive member 60 being connected through a drive adaptor 59 to one of the socket members 74.

Then, the socket wrench member 51 is shown connected to the aforementioned plug/connecting member 60 which in turn is connected to one of the socket members 74.

Figure 28:
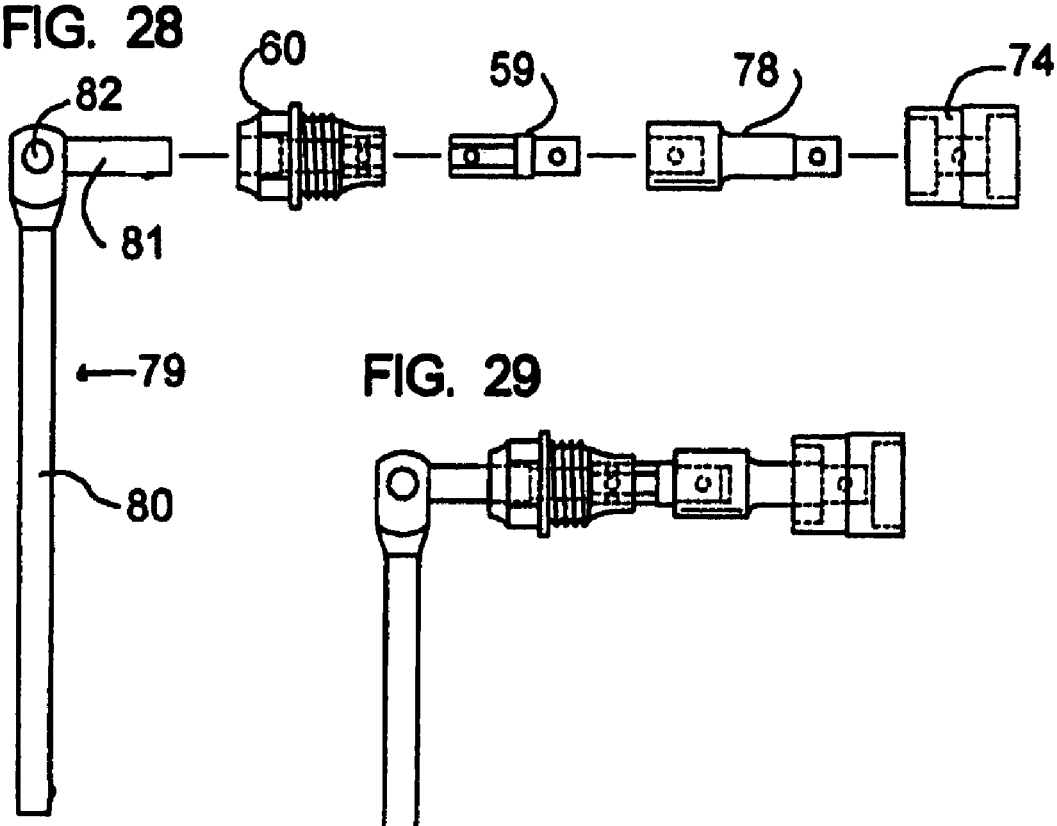
FIG. 28 is an exploded side elevational view showing the lever drive member in a position to be connected to several drive related members.

FIG. 28 shows use of the various components from the two handle sections 18 and 20 to provide a drive member combination which utilizes the leverage provided by the lever drive member 79 in conjunction with a number of the other components to drive some member which is rather inaccessible. This can be seen in FIG. 28, the lever end portion 81 is positioned at a right angle to the handle portion 80, and it is in turn is connected to four components in series, namely the plug/drive member 60, the drive adaptor 59, the extension drive member 78, and finally one of the socket members 74. Thus, three of the drive components from the wrench section 14 are combined with two of the components of the hammer section 12 to form this drive combination.

Figure 29:
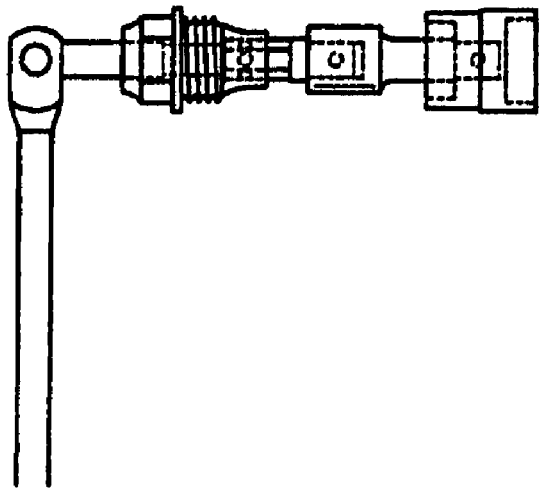
FIG. 29 is a view similar to FIG. 28 but showing the components in FIG. 28 connected to one another.

FIG. 29 shows the components of FIG. 28 connected to one another.

Figure 30:
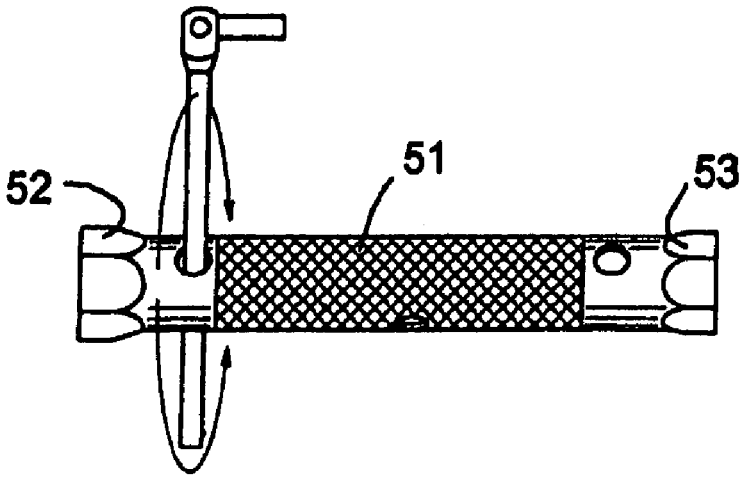
FIG. 30 is a side elevational view showing the socket wrench with the lever drive member being positioned in through openings thereof to be in a position to rotate the socket wrench.

In FIG. 30, there is an arrangement which was discussed earlier in this text, and this is where the lever drive member 80 is used in conjunction with the socket wrench member 51 to drive the socket wrench which would be connected by one or the other of the socket portions 52 and 53.

i) The Configuration of the Hexagonal Socket and Head Members Relative to the Driven Hexagonal Member Reference is now made to FIGS. 31 through 34 to present a modified configuration of the recessed portion of one of the socket portions 75 or 76 of the socket 74. A conventional socket wrench which is used to drive a hexagonal member such as the hexagonal head of a nut will normally comprise a socket recess having six interiorly facing flat surfaces in the form a regular hexagon having a moderately close tolerance fit relative to the head or nut so that these can be more easily moved into engagement with the hexagonal nut or other member to be driven, and yet be sufficiently snug to accomplish the drive action properly. The terms "head" or "nut" are to be interpreted in a broader sense to include a member which is to be engaged by a socket tool to rotate it. Thus it could be a nut with a threader center opening or the head of a bolt.

One of the problems that can occur is that if the person is dealing with socket members and driven hexagonal members that are dimensioned in accordance with the metric system as well as the English system of foot and inches, it is sometimes difficult to find a match to obtain a proper fit. Also, if the recess of the socket member is somewhat larger than the corresponding dimensions of the nut or other hexagonal member that is driven, even though the drive rotation may be able to be accomplished, there is bearing contact of only the abrupt juncture edge locations of the nut relative to the interior socket surfaces so that wear and/or damage is more likely to occur. Also, sometimes the fit is sufficiently loose (or tight) so that it is not possible (or at least difficult) to operate the socket wrench without a sloppy connection or difficulty in making the connection between the socket and the nut or other member to be engaged.

Another consideration is that if the fit is a tight fit within close tolerances, it can sometimes be difficult to get the socket wrench in precise alignment position to make the connection.

To alleviate these problems, there is the modified socket design which is shown in FIGS. 31-34. However, before describing this design, let us first lay a basis for terminology with reference first to FIG. 31*a*, which shows the outline of a hex head 253 (a hexagonal head). A common hex head 253 of a bolt or the like has six flat surface portions 254, each having a side surface center location 255, and six juncture surface locations 256 where an adjacent pair of the flat surface portions 254 meet at a corner. A diameter measurement of the head 253 is greater when measured between diametrically opposite juncture locations 256 (i.e., the juncture location diameter 257), and a diameter measurement of the head 253 is less when measured between two opposite side center surface locations 255 (i.e., the side center, surface location diameter 258).

Figure 31:
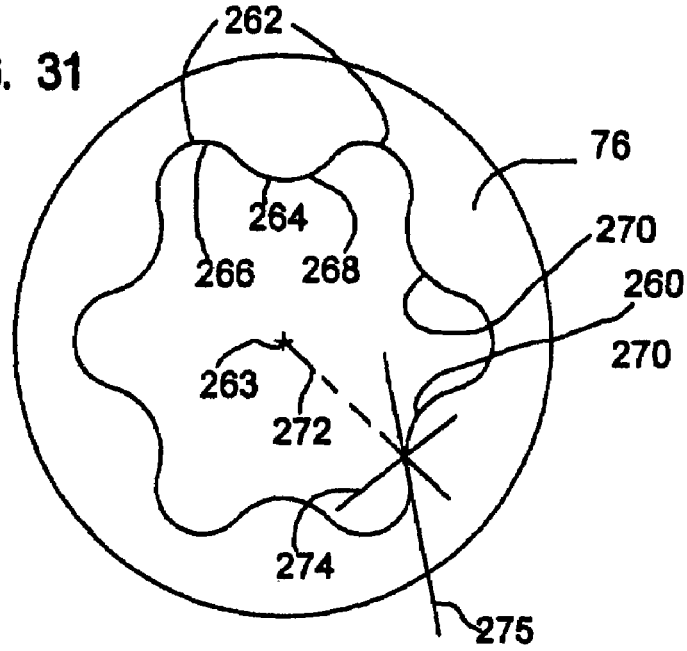
FIG. 31 is a somewhat schematic view of one version of the configuration of an internal surface of a socket portion of one of the socket members.
Figure 31A:
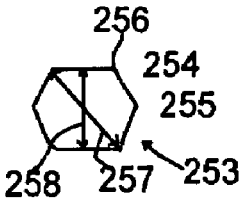
Figure 32:
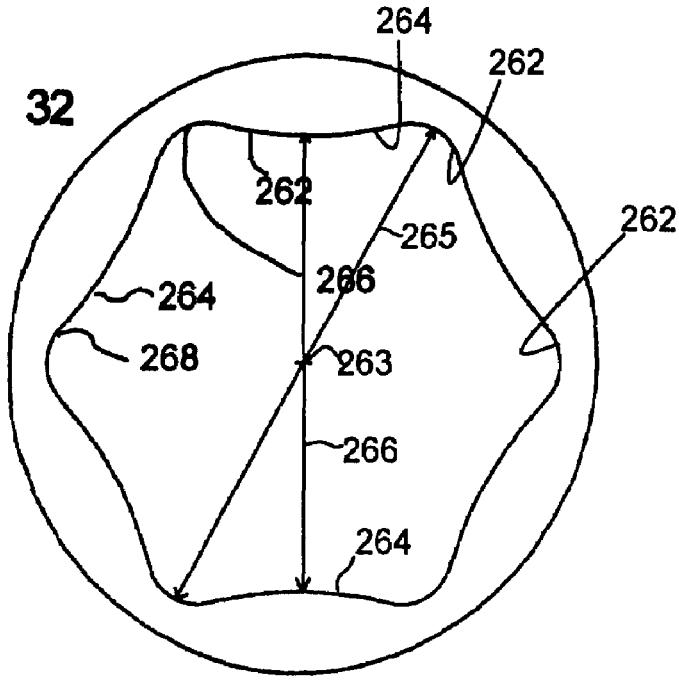
FIG. 32 is a view similar to FIG. 31, with the interior surface being shown in a somewhat different configuration.

As a next step, with reference initially to FIGS. 31 and 32, let us now relate these locations of the hexagonal nut (or head 253) to the locations of the socket interior surface contour 260.

With reference to FIG. 31 and 32, the interior surface 260 is considered to have six interior recessed surface locations that are considered to be juncture related locations 262 which are located further from the center location 263 and at evenly spaced intervals in the surface 260. Then there are six inwardly protruding mid surface locations 264 which are closer to the center 263 and evenly spaced intermittently with the juncture related locations 262 and which would correspond to the mid locations of the six side surfaces of the nut that is centrally positioned. The distance 265 between each diametrically opposed pair of juncture related surface locations 262 should be at least a small amount greater than the head junction location diameter 257 of the head or nut 253.

Also, the distance 266 between each opposed pair of the mid surface locations 264 should be greater than the side center surface location diameter 258 and less than the head function location diameter 257.

To explain this further, if we assume that the hexagonal nut or other driven member is located in a centrally located neutral position within the interior surface 260, the juncture edge locations 256 of the head or hex nut 253 will be located generally adjacent to (and generally radially aligned with) the corresponding juncture related locations 262 of the head surface 260, while the mid surface locations 264 will be generally adjacent to (and generally radially aligned with) the corresponding mid surface location 255 on the nut or other hexagonal member 253 that is being driven.

In all of FIGS. 31-34, it can be seen that the six juncture related locations 262 have an interiorly formed concave curved surface 266 at which the juncture edges of the nut in the neutral position would be located. Then at each mid surface locations 264, the surface 262 is formed as a convexly curved surface 268, that is nearer to the center location. As indicated above, the distance between diametrically opposite pairs of these concavely curved surface portions 268 is at a lesser distance than a diametrically aligned distance between two juncture related surface locations 262.

Then between each mid surface related location 264 and juncture related location 262 there is a transition surface portion 270 which is slanted relative to a reference line that would perpendicular to the adjacent radius of the interior surface 260 (see FIG. 31). To illustrate this, there is drawn a radius reference line 272 and a reference line 274 perpendicular to the radius line 272. The transition surface portion 270 is slanted (as indicated by the line 275) relative to the radius perpendicular reference line 274.

Figure 33:
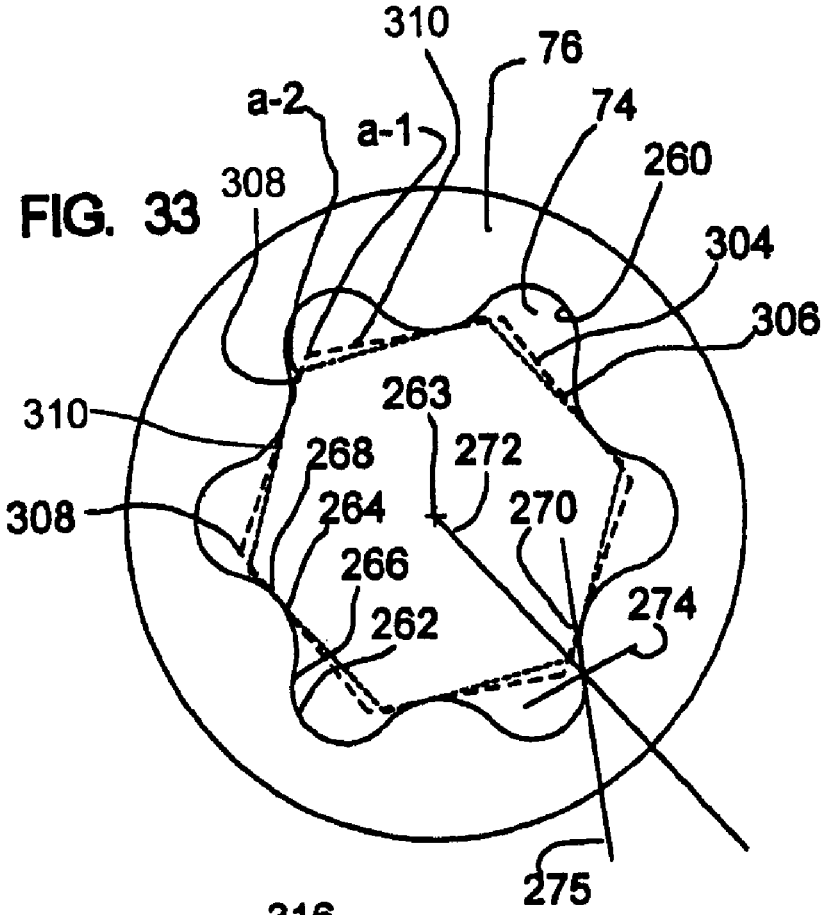
FIG. 33 is a view substantially the same as FIG. 31, but showing in addition in broken lines a nut or other hexagonal member being positioned within the socket member.

Now to discuss the operation of this socket portion 76, attention is called to FIG. 33, which shows the same socket member as shown in FIG. 31, having the interior surface 260. There is added a conventional hexagonal head 304 (hereinafter called the "hex head 304") which is to be driven. This hex head 304 has the six flat drive surfaces 306, six juncture locations 308 where the pair of two adjacent drive surfaces 306 join one another. Then each hex head surface 306 has a mid length location 310 which is half way between the two juncture locations 308.

In FIG. 33 we shall assume the socket 76 is the drive member and is rotating clockwise, and the hex head 253 is shown in broken lines in an engaged position and is just beginning to be moved in a clockwise direction. When the socket member 76 is moved clockwise a short distance from a neutral position, the mid surface related locations come into contact with the six flat surfaces 254 of the head or nut 253 to rotate the head or nut 253 clockwise. It readily becomes apparent that with the configurations shown in FIG. 31 through 33, there is a certain amount of angular tolerance in engaging the hex head 293 with the socket surface 360.

Figure 34:
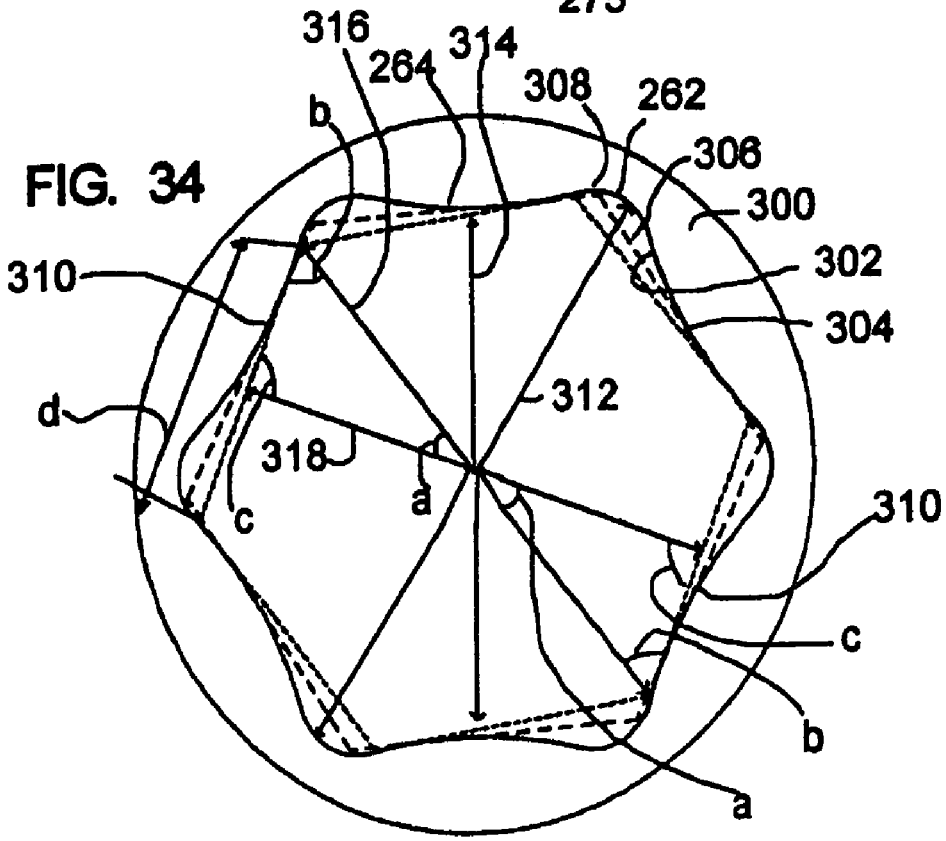
FIG. 34 is a view similar to FIGS. 32 and 33, but showing in addition several lines to illustrate geometric relationships of these components.

Let us now discuss some of the dimensional relationships of the socket inner surface 260 and the hex head 293, and this will be done with FIG. 34. In FIG. 34 there are drawn four dimensional lines. First, there are shown dimensional lines 312 and 314 which are the distances of, respectively, the distance 312 between the two juncture related locations 262 and the dimension 314 which is the distance between the two mid-surface related locations 264 (these dimensions relating to the inner surface 260 of the socket portion 276). Then there are two dimension lines 316 and 318 for the hex head 293. First, there is the distance 316 which extends between the two diametrically opposed juncture locations 308 of the hex head 304.

An examination of FIG. 34 will reveal that if the lines 316 and 318 are drawn as adjacent lines, the two diameters 316 and 318 form with the line of the adjacent side surface 306 of the hex head 304 two right triangles, with each of these triangles having 30 degree angle "a", a 60 degree angle "b" and a right angle "c". Analysis will further make it apparent that on the basis of the geometrical relationships, that the hex head juncture location diameter 316 is exactly twice the length of any one length (indicated at "d") of any of the hex head flat drive surfaces 306. Also, the hex head mid length diameter 318 is 86.6 percent of the hex head juncture location diameter 316.

To discuss how this relates to the relative dimensions of the inner surface 260 of the socket portion 76, the distance 312 between the juncture related locations 262 of the surface 260 should be at least as great or greater than the distance 316 between the two juncture locations 58 of the hex head 304. Then the distance 314 between the mid-length related locations 264 should be no less than a distance 318 between the distance 318 mid-length locations 310 of the hex head 304 and no greater than the distance 316 between the juncture locations 308.

Also, desirably, the depth of the juncture related location recesses 262 could be made having a greater depth as shown in FIG. 3 and also a width dimension that would be adequate so as to allow some tolerance in the placement of the juncture locations 308 of the hex head 304.

j) Second Embodiment of the Invention

Figure 35:
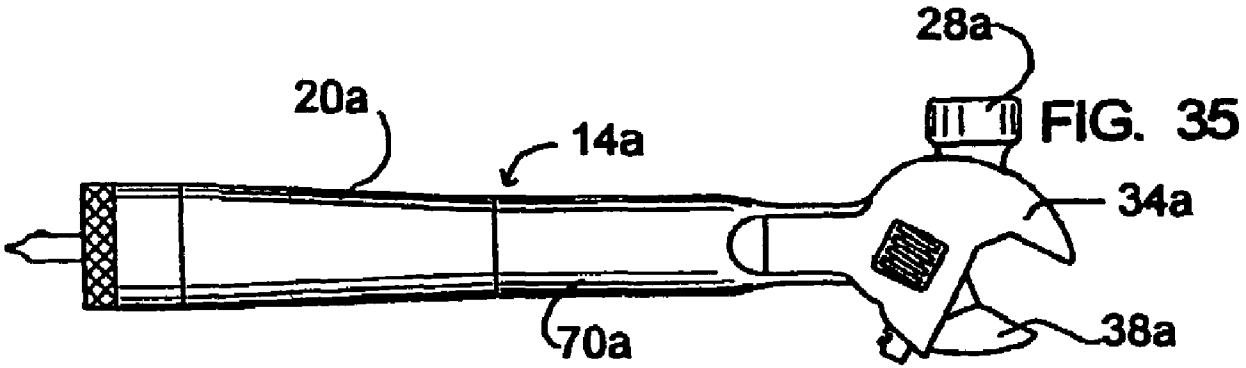
FIG. 35 is a side elevational view of a second embodiment, which comprises only a wrench section along with the components stowed therein.
Figure 36:
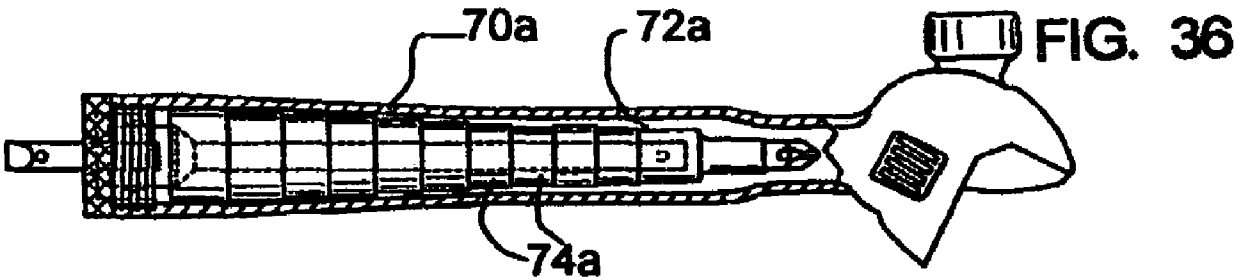
FIG. 36 is a view similar to FIG. 35, but showing the handle in a longitudinal sectional view, with the socket members and the lever drive member being in a stowed position.
Figure 37:
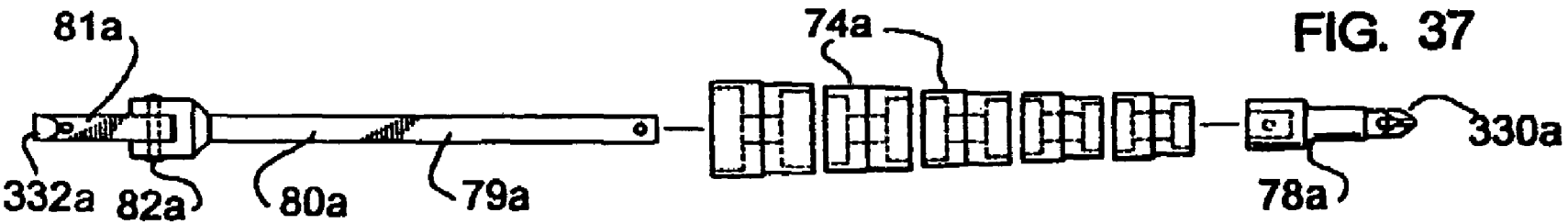
FIG. 37 is a side elevational view showing the socket members, an end drive/screw tip member and the lever drive member with a screw tip added.

Reference is now made to FIGS. 35-37 to present a second embodiment of the invention. It can be seen by examining FIGS. 35-37 that this second embodiment is essentially a wrench combination tool that is quite similar to the wrench section 14 of the first embodiment, but with some modifications.

Accordingly, in describing this second embodiment, for those components which are substantially the same as (or rather similar to) certain components of the first embodiment, like numerical designations will be given, with an "a" distinguishing those of the second embodiment.

Thus, it can be seen that there is a wrench 14*a* which has a handle section 20*a* and also a hammer head 28*a*. There is a stationary jaw 34*a* and a moveable jaw 32*a*. With regard to the position of the hammer head 28*a*, in this embodiment this has been placed at a side location on the stationary jaw 34*a*.

The handle section 20*a* is substantially the same as the handle section 20 of the first embodiment. There is the handle structure 70*a* having the storage region 72*a* in which is positioned the socket drivers 74*a*. Also, there is the lever drive member 79*a* with the handle portion 80*a* and the driver end of portion 81 a with the hinge location 82*a*. Further, at the upper end there is the end drive connector 78*a*.

However, this handle section 20*a* differs from the handle section 20 in that the upper end of the drive connecting than the end drive connector 78*a* has its upper end having an end tip 330*a* formed as a Philips head screw driver, in addition to be shaped as a drive connecting member. Also, the free end portion of the drive end 81 a has an end tip configuration 332*a* of a conventional screw driver.

This wrench 14*a* along with the various components described in this text relating to this second embodiment operates in substantially the same way as the wrench section 14 of the first embodiment, except for those functions which would involve components of the two sections 12 and 14 of the first embodiment. Therefore, it is believed that it would not be necessary in this text to discuss in any detail these functions.

k. Third embodiment of the Invention

Figure 38:
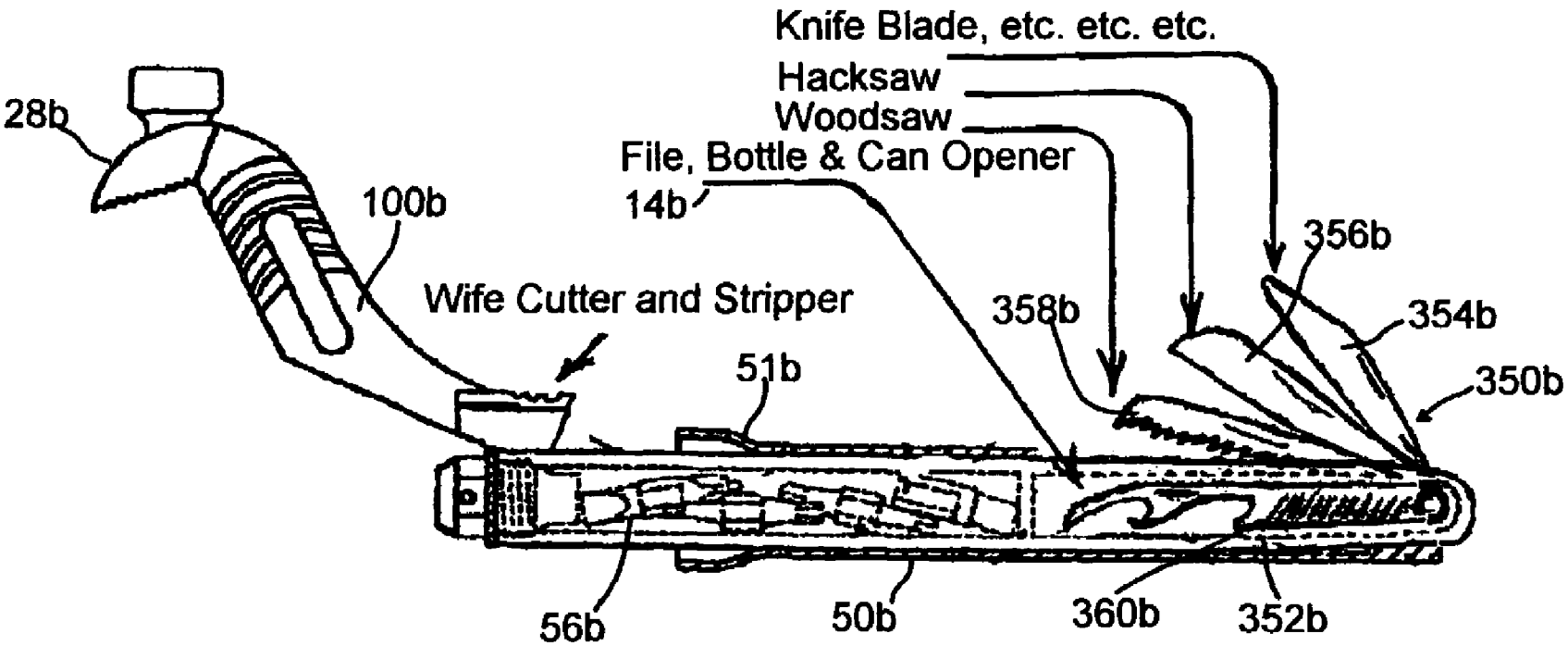
FIG. 38 shows a third embodiment of the present invention, components of this third embodiment which are the same as (or similar to) components of the earlier embodiments will be given like numerical designations with a "b" distinguishing those of this third embodiment.

This third embodiment is a modification of the wrench section 12*b*. In this third embodiment the wrench main section remains the same. Thus, it is not shown in FIG. 38.

The upper part of the hammer section 12*b* is essentially the same as in the first embodiment, comprising the arm 100*b*, the hammer head jaw 28 and the other structural components in that upper section. Also, the upper part of the forward part of the handle section remains in large part the same in that there is a handle structure 50*b* and also the surrounding socket wrench 51*b*. Also there is the forward (or upper) storage region 56*b* containing the screw tips.

However, the multi-purpose tool 64 of the first embodiment has been removed, and in its place there is provided a combination tool section which has the configuration of a pocket knife where there are a number of pivotally mounted tools which collapse into a handle portion and can be selectively rotated out into an operating position. Thus, in FIG. 38 there is shown the lower combination tool 350*b* which comprises a containing section 352*b* which is an extension of the handle. There are shown four tool components somewhat schematically. There is a knife section 354*b* with an end tip and a second knife section 356*b* which may have multi-sections. Then there is a saw blade 358*b*. Finally, shown in its stowed position is a multi-purpose tool 360*b* which would be similar to the components 194, 188, and 194 of the first embodiment. Obviously, there can be various selections of combinations of tools which could be used.

It is to be recognized that various modifications could be made to these components, and various arrangements of the same could be made, without departing from the basic teachings of these embodiments.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those skilled in the art. The invention in its broader aspects is therefore not limited to the specific details, representative apparatus and methods, and illustrative examples shown and described. Accordingly, departures may be made from such details without departing from the spirit or scope of applicants' general concept.

I claim:

1. A multi-task combination tool comprising:

a. a first main section comprising a hammer handle section and an upper located hammer related operating section connected to the hammer handle section;

b. said upper hammer related operating section comprising a hammer impact portion having a hammer impact surface and a first jaw portion having a first gripping surface;

c. a second main section comprising a wrench handle section and an upper located wrench related operating section;

d. said upper wrench related operating section comprising a second jaw portion with a second gripping surface arranged to act with the first gripping surface, and also comprising a wrench related third gripping surface;

e. said upper located wrench related operating section further comprising a wrench related third jaw portion which has a wrench related moveable third jaw portion which comprises a wrench related fourth gripping surface to coact with said third gripping surface;

f. said first and second main sections being arranged to be able to be moved about a pivot location with respect to one another so that the first and second gripping surfaces move both toward and away from each other.

2. The apparatus as recited in claim 1, wherein said combination tool had a right side and a left side, and said hammer handle section and wrench handle sections each have a respective longitudinal handle axis; said hammer handle section and said wrench handle section have an adjacent position and a distant position and in the adjacent position the hammer handle and wrench handle longitudinal handle axes are generally aligned with one another and there is a middle alignment axis which is between and generally aligned with said hammer handle and wrench handle longitudinal handle axes when in the adjacent position, said hammer section having a rigid hammering structure comprising a hammer handle hand grip located structure portion as part of the hammer handle section and a hammer related extension portion extending from the hammer handle related grip portion across the middle alignment axis with the tool in the adjacent position to connect to the hammer impact portion.

3. The apparatus as recited in claim 2, wherein said hammer impact portion is to the right of the second jaw portion.

4. The apparatus as recited in claim 2, wherein said extension portion is spaced laterally from an upper end portion of said hammer handle section and there is an upper handle access region at said upper end portion of said hammer handle section.

5. The apparatus as recited in claim 4, wherein there is in said hammer handle section a hammer handle section storage region.

6. The apparatus as recited in claim 4, wherein a lower end portion of said hammer handle has a lower storage region.

7. The apparatus as recited in claim 1, wherein said hammer handle section comprises a rigid hammering support structure and there is a shell structure removably positioned at least partially around the hammering support structure, said shell structure comprising at least one end located socket wrench portion.

8. The apparatus as recited in claim 7, wherein there are two end socket wrench portions at opposite ends of the shell structure.

9. The apparatus as recited in claim 7, wherein said shell structure comprises at least one opening portion arranged to receive a lever member to rotate said shell structure when operating as a socket wrench.

10. The apparatus as recited in claim 7, wherein said hammer handle section has first and second end portions, at least one of said end portions having a storage region, an auxiliary multi-purpose tool comprising a mounting end portion and an operating end portion, said mounting end portion being able to be positioned in said storage region in a manner to position the operating end portion in its operating position and also being able to be positioned in the storage region to position the operating region in the storage region.

11. The apparatus as recited in claim 10, wherein said auxiliary multi-purpose tool has a releasable retaining portion to retain the shell structure in its position on the hammering support structure.

12. The apparatus as recited in claim 1, wherein said hammer handle section comprises a rigid hammering support structure having at least one of said end portions having a storage region, an auxiliary multi-purpose tool section comprising a mounting end portion and an operating end portion, said mounting end portion being able to be positioned in said storage region in a manner to position the operating end portion in its operating position and also being able to be positioned in the storage region.

13. The apparatus as recited in claim 12, wherein there is a connecting section between a mounting portion and an operating portion of the multipurpose tool section, and having a wrench engaging portion arranged to be engaged by a wrench.

14. The apparatus as recited in claim 11, wherein operating end portion comprises one or more of a knife, a saw edge, a file, an all purpose conversely curved cutting edge, a can opener and a bottle opener.

15. The apparatus as recited in claim 11, wherein said hammering support structure has a storage section having another opening at a second end portion of the hammering support structure and a plug member adapted to be positioned in said of opening, said plug member comprising a driver end portion configured to be driven by a drive member, a threaded plug portion and a drive socket.

16. The apparatus as recited in claim 1, wherein said pivot connection is length adjustable with respect to one another so that a gap distance between the first and second gripping surfaces is length adjustable, and said first and second sections are removably connected to one another so that the first and second sections can be separated to function independently from one another.

17. The apparatus as recited in claim 1, wherein each of the handle sections comprises a storage region, in each of which is positioned one or more of the following in a stowed position:

a. a plurality of socket drive members;
b. a plurality of socket drive members having a pair of oppositely positioned socket recesses aligned with one another in one of said storage regions and having aligned through openings with an elongated extension drive member extending through said aligned through openings in a stowed position.
c. a plurality of screw tips adapted to be connected to drive members also stowed in a stowed position;
d. a multipurpose tool section comprising one or more of a knife section, a file, a can opener, a bottle opener, a saw edge;
e. at least one drive extender.

18. The apparatus as recited in claim 1, wherein:

a. said combination tool had a right side and a left side, and said hammer handle section and wrench handle sections each have a respective longitudinal handle axis; said hammer handle section and said wrench handle section have an adjacent position and a distant position and in the adjacent position the hammer handle and wrench handle longitudinal handle axes are generally aligned with one another and there is a middle alignment axis which is between and generally aligned with said hammer handle and wrench handle longitudinal handle axes, said hammer section having a rigid hammering structure comprising a hammer handle hand grip located structure portion as part of the hammer handle section and a hammer related extension portion extending from the hammer handle related grip portion across the middle alignment axis with the tool in the adjacent position to connect to the hammer impact portion;
b. each of the handle sections comprises a storage region, in each of which is positioned one or more of the following in a stowed position:
   i. a plurality of socket drive members;
   ii. a plurality of socket drive members having a pair of oppositely positioned socket recesses aligned with one another in one of said storage regions and having aligned through openings with an elongated extension drive member extending through said aligned through openings in a stowed position;
   iii. a plurality of screw tips adapted to be connected to drive members also stowed in said storage regions in a stowed position;
   iv. a multipurpose tool section comprising one or more of a knife section, a file, a can opener, a bottle opener, a saw edge;
   v. at least one drive extender;
c. said hammer handle section has at its upper end an access opening through which items can be passed into and from the storage region in the hammer handle section without interference from the upper hammer related operating section; and
d. said wrench handle section has at its lower end an access opening through which items can pass into and from the storage region in the wrench handle section so that the wrench related operating section can be located to be in general alignment with the wrench handle longitudinal axis.

19. The apparatus as recited in claim 1, wherein there is at least one socket member which is arranged to engage in drive relationship a male drive member having a surrounding side surface comprising a number of substantially flat surface portions which have juncture locations and each of which has a side surface center location, with oppositely positioned juncture locations having a male drive junction diameter, and with oppositely positioned flat surface positions having a side center surface location diameter, said socket member comprising:

a. an interior surface comprising a number of recessed surface locations which are located at a first greater distance from a center location of the interior surface with oppositely positioned pairs of said recessed surface locations being spaced from one another by a socket recess greater distance, which is a greater socket diameter;

b. said interior surface comprising a number of inwardly protruding socket mid-surfaces at mid-surface locations, each of which is located between a related pair of adjacent recessed surface locations, with oppositely positioned inwardly protruding mid-surface locations being positioned at a lesser distance from said center location surface, with oppositely positioned inwardly protruding mid-surfaces having a lesser socket diameter;

c. said mid-surfaces of each having a convex surface configuration with a mid-contact region that transitions into curving slanted side contact regions contoured to engage flat surfaces of the male drive member; and d. said socket member being adapted to be in drive engagement with a male drive member having a side center surface location diameter no greater than or less than said lesser socket diameter and having a male drive junction diameter at least as great as or greater than said lesser socket diameter, whereby the socket member can be adapted to be operable, for example, when the socket member is used in connection with male drive members sized in accordance with metric measure or in foot/inch measure.

20. A method of selectively accomplishing one or more of a hammering operation, a pliers gripping action, or a wrench gripping action, by providing and operating components of a multi-task combination tool, said method comprising:

a. providing a first main section comprising a hammer handle section and also an upper located hammer related operating section connected to the hammer handle section;

b. providing said upper hammer related operating section with a hammer impact portion having a hammer impact surface and also providing a first jaw portion having a first gripping surface;

c. providing a second main section comprising a wrench handle section and an upper located wrench related operating section;

d. providing said upper wrench related operating section with a second jaw portion with a second gripping surface arranged to coact with the first gripping surface, and also providing for said second jaw portion a wrench related third gripping surface;

e. providing said upper located wrench related operating section with a wrench related third jaw portion with a wrench related moveable third jaw portion which comprises a wrench related fourth gripping surface to coact with said third gripping surface;

f. accomplishing one or more of the following tasks:

i) providing said first and second main sections with a pivot connection and moving said first and second main sections about said pivot location with respect to one another so that the first and second gripping surfaces move both toward and away from each other in performing a pliers function;

ii) moving the hammer operating section to perform a hammer function; and iii) operating said wrench section in a wrench gripping function.

* * * * *